US012752173B2

(12) United States Patent
Brown

(10) Patent No.: US 12,752,173 B2
(45) Date of Patent: Oct. 6, 2026

(54) MODULAR GYM AND METHOD OF USE THEREOF

(71) Applicant: Duane Scott Brown, Rancho Santa Margarita, CA (US)

(72) Inventor: Duane Scott Brown, Rancho Santa Margarita, CA (US)

( * ) Notice: Subject to any disclaimer, the term of this patent is extended or adjusted under 35 U.S.C. 154(b) by 262 days.

(21) Appl. No.: 18/601,404

(22) Filed: Mar. 11, 2024

(65) Prior Publication Data

US 2024/0299828 A1 Sep. 12, 2024

Related U.S. Application Data

(60) Provisional application No. 63/451,565, filed on Mar. 11, 2023.

(51) Int. Cl.
*A63B 71/02* (2006.01)
*A63B 1/00* (2006.01)

(52) U.S. Cl.
CPC ..... *A63B 71/023* (2013.01); *A63B 1/00* (2013.01)

(58) Field of Classification Search
CPC ..... A63B 71/023; A63B 1/00; A63B 69/22; A63B 2210/50; A63B 17/04
See application file for complete search history.

(56) References Cited

U.S. PATENT DOCUMENTS 4,781,374 A * 11/1988 Lederman ..... A63B 21/154 482/99
4,858,922 A * 8/1989 Santavaci ..... A63B 24/0021 473/192
5,221,243 A * 6/1993 Walker ..... A63B 69/0053 482/83
6,579,196 B1 * 6/2003 Yoon ..... A63B 71/023 473/421
D629,472 S * 12/2010 Rhodes ..... D21/675
9,504,871 B2 11/2016 Muñoz Saez
10,941,561 B2 * 3/2021 Miller ..... E04B 1/388
2003/0181264 A1 * 9/2003 Yoon ..... A63B 71/023 473/421
2009/0069161 A1 * 3/2009 Caldwell ..... A63B 21/4035 482/142
2015/0065316 A1 * 3/2015 Towley, III ..... A63B 21/078 482/104
2016/0059104 A1 * 3/2016 Monaco ..... A63B 71/023 280/30
2016/0059105 A1 * 3/2016 Scade Garcia ..... A63B 71/02 52/64

(Continued)

FOREIGN PATENT DOCUMENTS

WO WO 2012140622 A1 10/2012

*Primary Examiner* — Andrew S Lo
(74) *Attorney, Agent, or Firm* — Innovent Law P.C.; Karima Gulick

(57) ABSTRACT

A modular exercise structure comprising a frame and a first panel. The frame has a base and a plurality of first column and a second column detachably coupled with the base and oriented vertically. The first panel is located between the first column and the second column. The first panel has a first column coupler and a second column coupler disposed on two opposite ends of the first panel. The first and second column couplers are configured to respectively coupled with the first and second columns. The modular exercise structure is configured to be adjustable and modifiable.

18 Claims, 19 Drawing Sheets

(56) References Cited

U.S. PATENT DOCUMENTS

| | | | | |
|---|---|---|---|---|
| 2017/0056705 | A1* | 3/2017 | Zha | A63B 21/4035 |
| 2017/0209733 | A1* | 7/2017 | Beaver | A63B 23/1218 |
| 2018/0028852 | A1* | 2/2018 | Beaver | A63B 71/0036 |
| 2018/0028854 | A1 | 2/2018 | Christy | |
| 2018/0369631 | A1* | 12/2018 | Risacher | A63B 17/04 |
| 2019/0168092 | A1* | 6/2019 | Beaver | G09B 9/003 |
| 2019/0388721 | A1* | 12/2019 | Schlegel | A63B 69/34 |
| 2020/0130559 | A1* | 4/2020 | Calabria | B62D 63/08 |
| 2020/0222780 | A1* | 7/2020 | Scala | B65D 88/121 |
| 2020/0308830 | A1 | 10/2020 | Lee et al. | |
| 2021/0154548 | A1* | 5/2021 | Sudeith | A63B 23/1218 |
| 2021/0275888 | A1* | 9/2021 | Speed | A63B 69/0048 |
| 2022/0331681 | A1* | 10/2022 | Riley | B65D 90/00 |
| 2023/0356017 | A1* | 11/2023 | Mullen | A63B 71/0622 |

* cited by examiner

MODULAR GYM AND METHOD OF USE THEREOF

CROSS-REFERENCE TO RELATED APPLICATION

This application incorporates by reference and claims the benefit of priority to U.S. Provisional Application No. 63/451,565 filed on Mar. 11, 2023.

BACKGROUND OF THE INVENTION

1. Field of the Invention

This invention relates to a modular gym for exercising and attaching fitness and physical activity elements thereto. More particularly, the invention relates to a modular gym customizable in size, height and exercise activity by a user.

2. Description of the Related Art

In markets today, there are very limited products offered for modular gyms or products that allow a user to customize their own exercise space and have them adapted to their unique needs, space available and desired fitness equipment use.

Most of the solutions on the market today are bulky, complex and expensive. These solutions are marketed to gyms and professional athletes and are not easy to move or install. Most of the current solutions on the market are not versatile and are usually either tailored to weight lifting equipment, cardio equipment or mixed martial arts and boxing, but nothing on the market that allows a user to combine and change fitness equipment as they see fit. In addition, these types of structure are not conceived for daily or regular modular changes and typically require an installation team or specialized technicians to alter the gym once installed anywhere.

Currently, there are no useful alternatives that effectively assist a user in having a completely modular and alterable gym and exercise space at any time. As will be disclosed below, the present disclosure addresses these needs and covers a modular gym for exercising and method to assemble, rearrange and use a modular gym to prevent these inconveniences and solve these issues.

BRIEF DESCRIPTION OF THE DRAWINGS

It should be noted that the drawing figures may be in simplified form and might not be to precise scale.

DETAILED DESCRIPTION OF THE INVENTION

The embodiment and various other embodiments can be better understood by turning to the following detailed description, which are presented as illustrated examples defined in the claims. It is expressly understood that the embodiment as defined by the claims may be broader than the illustrated embodiments described below. Many alterations and modifications may be made by those having ordinary skill in the art without departing from the spirit and scope of the embodiments.

Figure 1A:
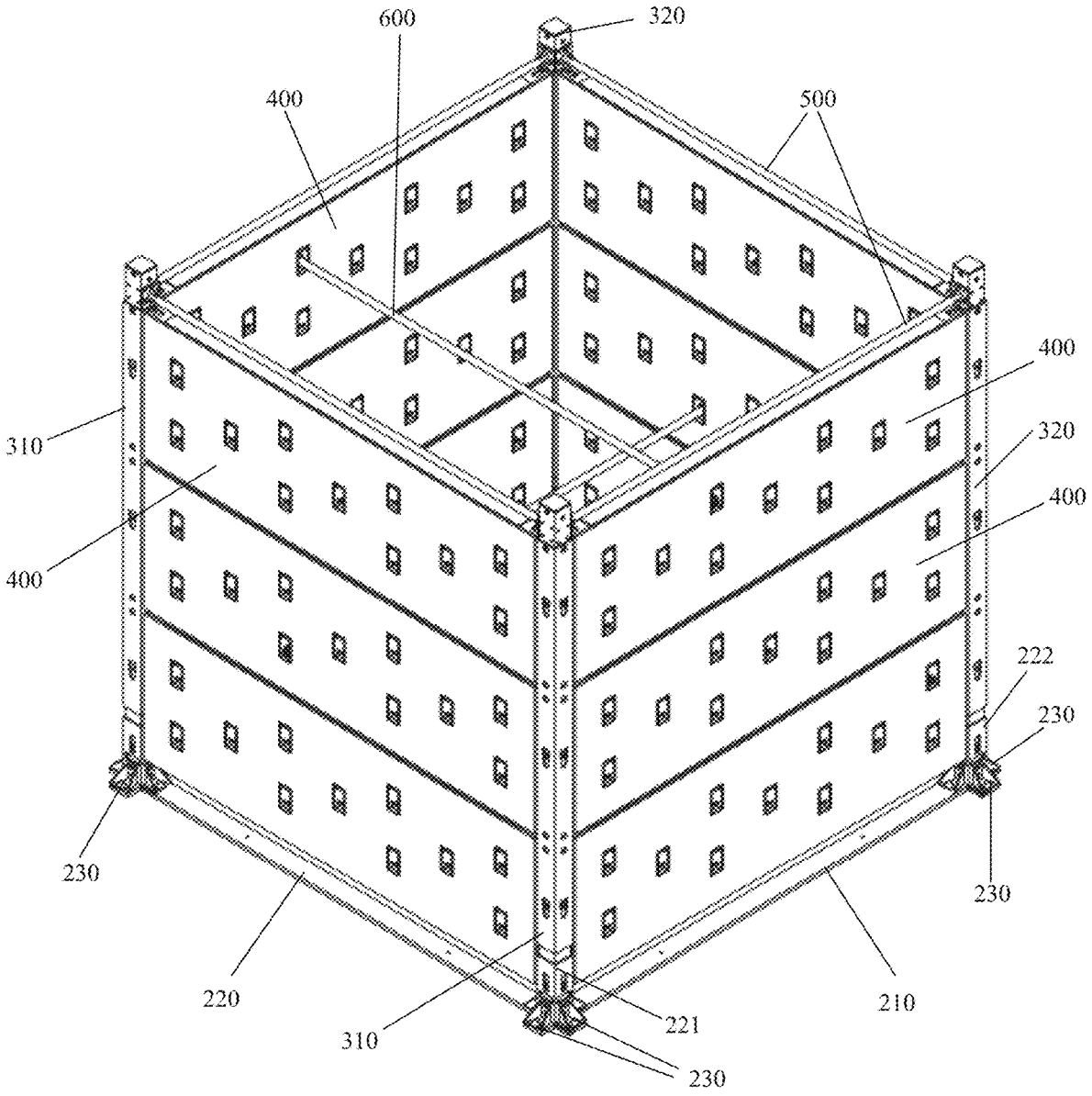
FIG. 1A is a perspective view of the modular gym according to a first embodiment of the present disclosure.
Figure 1B:
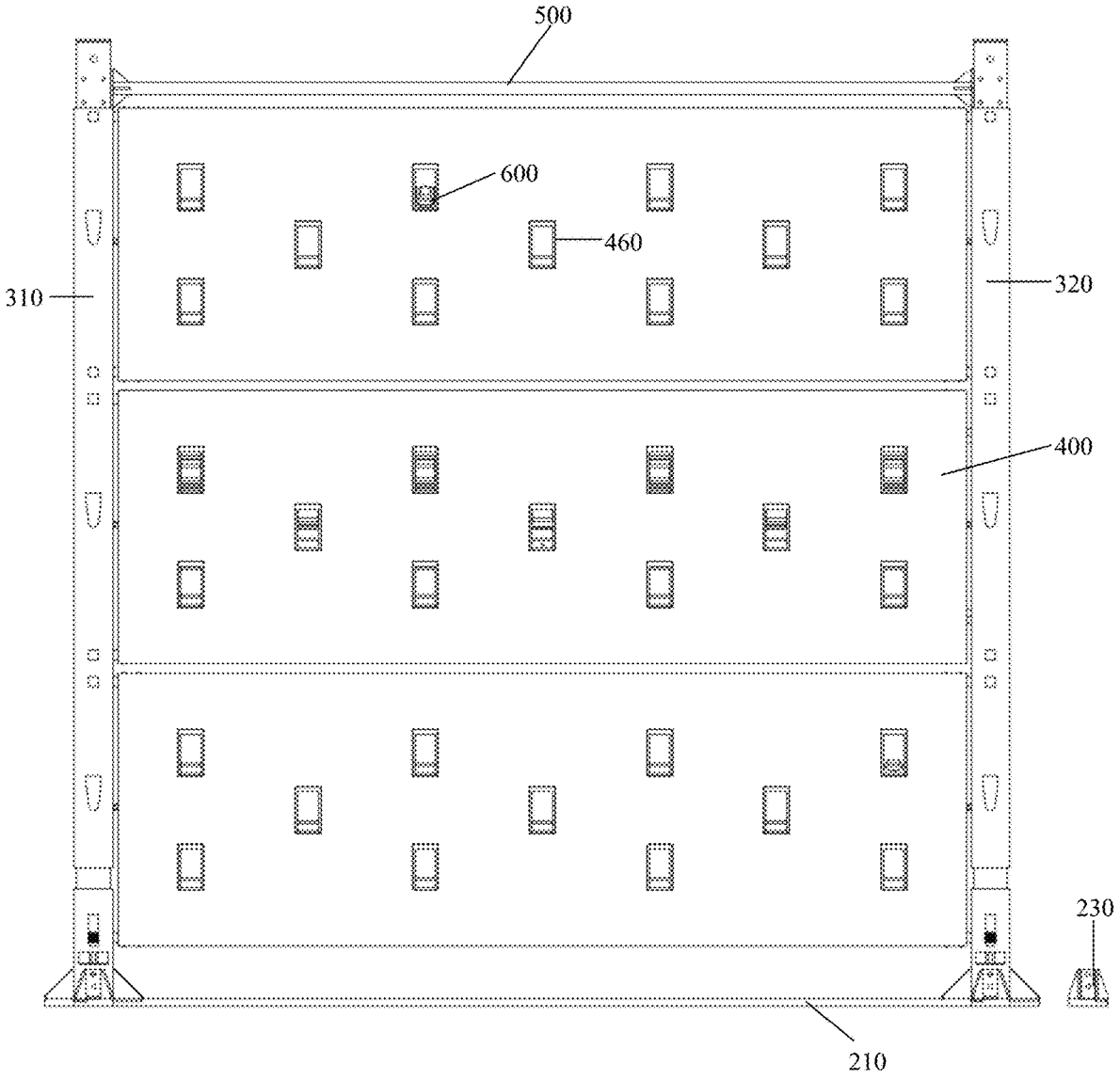
FIG. 1B is a side view of the modular gym according to the first embodiment of the present disclosure.

FIGS. 1A and 1B are respectively a perspective view and a side view of the modular gym according to a first embodiment of the present disclosure. The modular gym includes a frame and a plurality of panels 400 detachably attached to the frame and oriented vertically to form a wall. The frame includes a base and a plurality of vertical columns coupled with the base, wherein each of the panels 400 is located between two vertical columns and detachably coupled with said two columns.

Figure 2A:
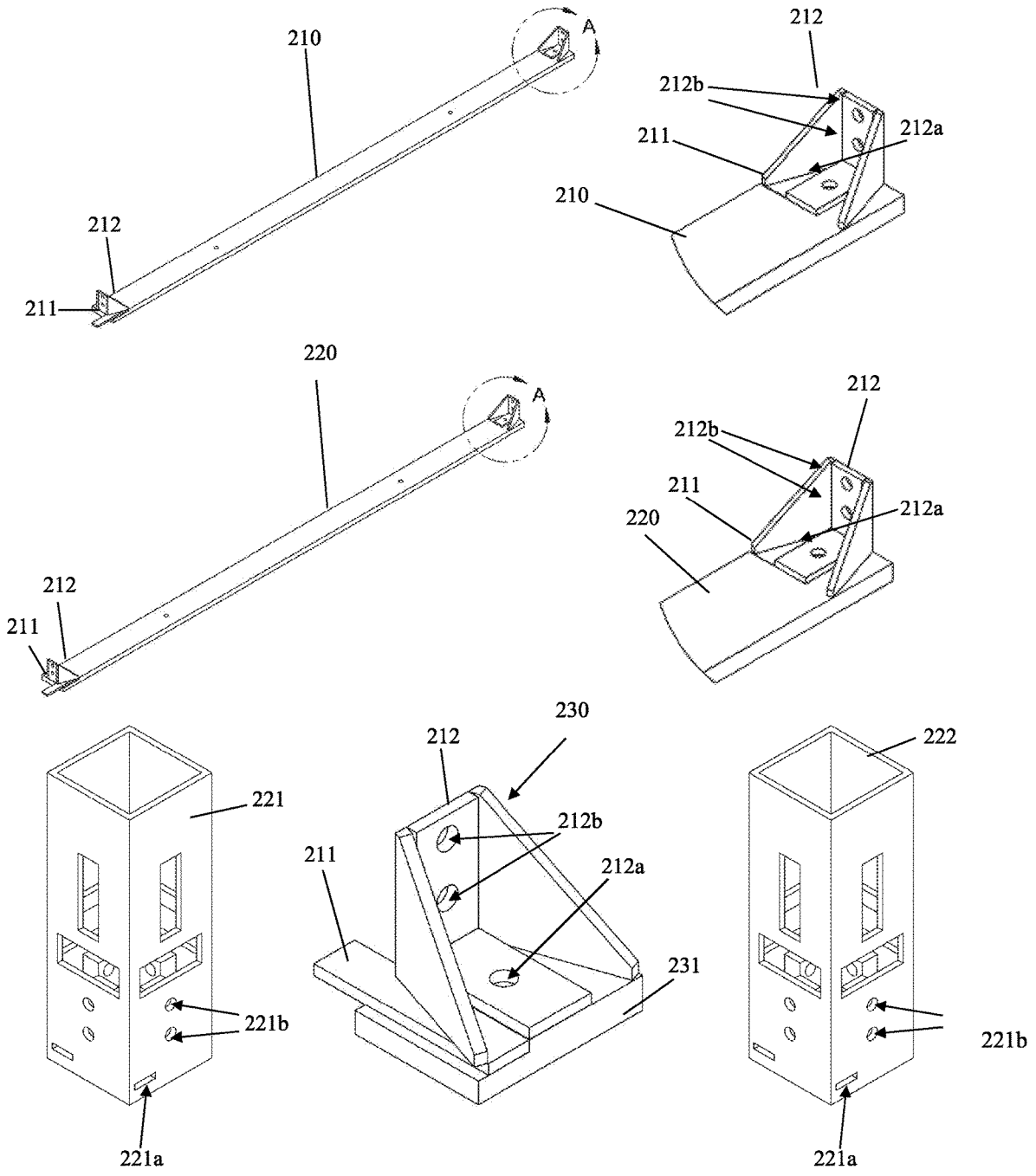
FIG. 2A is a perspective view of various components of the base according to the first embodiment of the present disclosure.
Figure 2B:
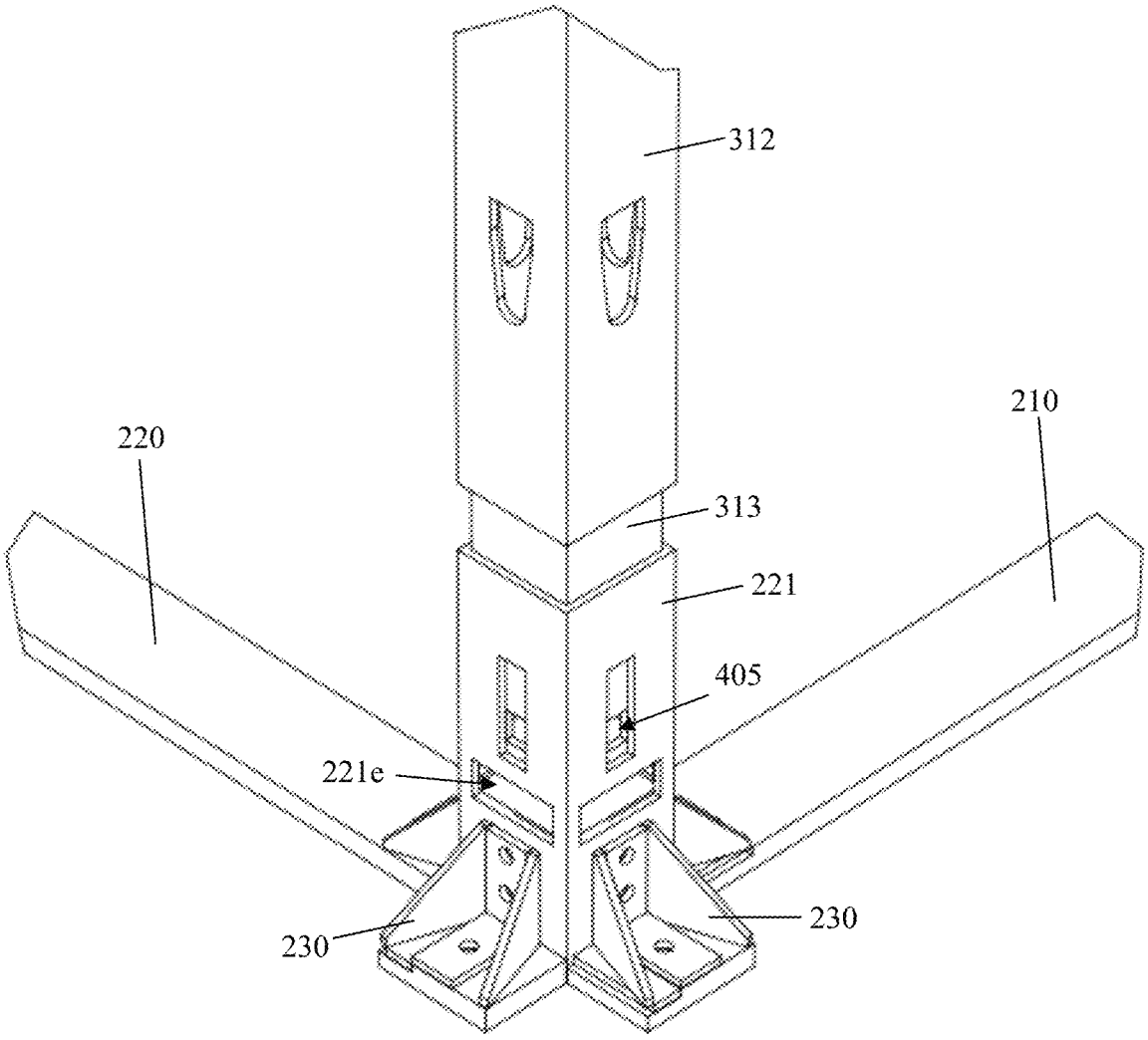
FIG. 2B is a perspective view of the base according to the first embodiment of the present disclosure.

FIG. 2A is a perspective view of various components of the base according to the first embodiment of the present disclosure. FIG. 2B is a perspective view of the base according to the first embodiment of the present disclosure.

Here please refer to FIGS. 1A-B and 2A-B for the description of various components of the frame. The base includes a first base member 210, a second base member 220, and a plurality of auxiliary base members 230. The base also includes a first column receptacle 221 coupled with one end of the first base member 210, one end of the second base member 220, and two auxiliary base members 230. The base further includes a second column receptacle 222 coupled with another end of the first base member 210, one end of another base member (not illustrated) and another two auxiliary base members 230.

As illustrated in FIG. 2A, the first base member 210 includes a first receptacle coupler 211 and a second receptacle coupler 212 disposed on both ends of the first base member 210. The auxiliary base members 230 has a substrate 231, a first receptacle coupler 211 and a second receptacle coupler 212. In the case of the first base member 210, the first receptacle coupler 211 is a small bar disposed on and extends outside one end of the first base member 210. The second receptacle coupler 212 is then disposed on both the first base member 210 and the first receptacle coupler 211. The second receptacle coupler 212 has a first threaded opening 212*a* and the first base member 210 also has a threaded opening (not illustrated) directly below the first threaded opening 212*a*, wherein a user can use a bolt or other fastener to couple the second receptacle coupler 212 with the first base member 210 through the corresponding threaded openings. The second receptacle coupler 212 also has a pair of second threaded opening 212*b* for bolts or other fasteners to couple the second receptacle coupler 212 with the first column receptacle 221 which will be explained below.

In the case of the auxiliary base members 230, the first receptacle coupler 211 is a small bar disposed on and extends outside the substrate 231. The second receptacle coupler 212 is then disposed on both the first receptacle coupler 211 and the substrate 231. The second receptacle coupler 212 has a first threaded opening 212*a* and the substrate 231 has a threaded opening (not illustrated) directly below the first threaded opening 212*a*, wherein a user can use a bolt or other fastener to couple the second receptacle coupler 212 with the substrate 231 through the corresponding threaded openings. The second receptacle coupler 212 also has a pair of second threaded opening 212*b* for bolt to couple the second receptacle coupler 212 with the first column receptacle 221 which will be explained below.

As illustrated in FIG. 2A, the first column receptacle 221 has four sides and each side has a plurality of openings of different shape and sizes. The first column receptacle 221 has a first coupler opening 221*a* configured to receive the first receptacle coupler 211. The first column receptacle 221 also has a pair of third threaded openings 221*b* corresponding to the second threaded opening 212*b*. When the first receptacle coupler 211 is properly inserted in the first coupler opening 221*a*, the second threaded opening 212*b* and the third threaded opening 221*b* will be adjacent to one another. A user can then use a bolts or other fasteners to couple the second receptacle coupler 212 with the first column receptacle 221.

The first base member 210 and the second base member 220 are identical in shape and size. The second base member 220 also has a first receptacle coupler 211 and a second receptacle coupler 212 disposed on both ends of the second base member 210. Thus, the second base member 220 will not be described again.

A user can further reinforce the load capacity of the first column receptacle 221 by coupling the two auxiliary base members 230, the first base member 210, and the second base member 220 with four sides of the first column receptacle 221 using bolts (or other fasteners) and corresponding threaded openings as described above to arrive at the structure illustrated in FIGS. 1A, 1B, and 2B.

Figure 3:
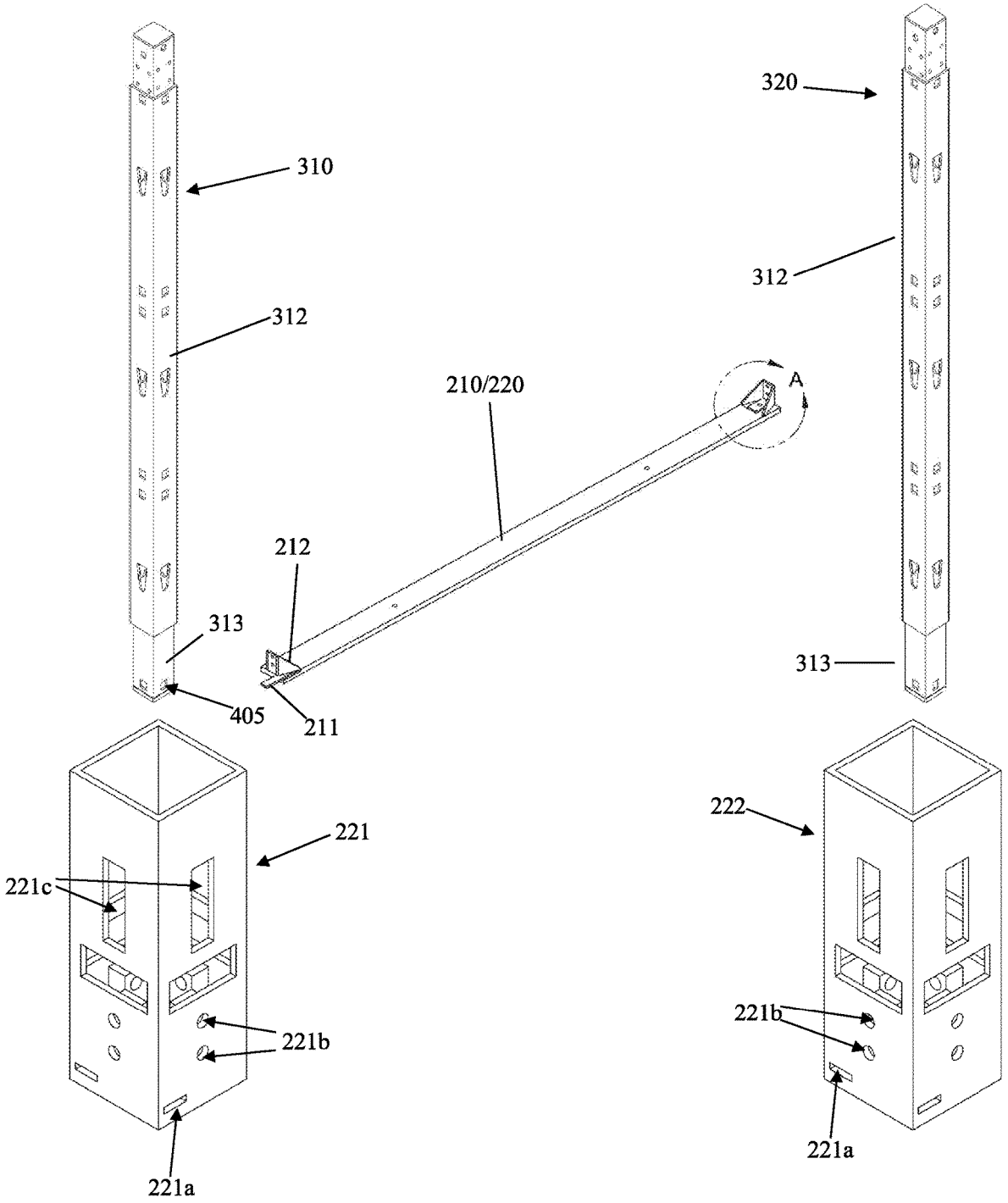
FIG. 3 is a perspective view of various components of the frame according to the first embodiment of the present disclosure.

FIG. 3 is a perspective view of various components of the frame according to the first embodiment of the present disclosure. The frame further includes a first column 310 detachably coupled with the first column receptacle 221 and a second column 320 detachably coupled with the second column receptacle 221. The first column 310 includes a center portion 312 and a first column ends 313 with reduced dimension. The dimension of the first column end 313 corresponds to the inner space of the first column receptacle 221. Thus, the first column receptacle 221 can receive the first column end 313 and maintain the first column 310 in a vertical orientation.

As illustrated in FIG. 3, the first column receptacle 221 further includes four rectangular second coupler opening 221*c* each formed on one side of the first column receptacle 221. On the other hand, the first column end 313 has a coupler openings 405 formed thereon. When the first column end 313 is inserted in the first column receptacle 221, the coupler openings 405 on the first column end 313 will be exposed through the second coupler opening 221*c*. Thus, the first portion 407*a* of the panel 400 (illustrated in FIGS. 6 and 7) can pass through the second coupler opening 221*c*, enters the coupler openings 405, and in the process couple the panel 400 with the first column 310. In the present embodiment, the first column receptacle 221 is not configured to receive the entire first column end 313. Thus, a portion of the first column end 313 may be exposed outside the first column receptacle 221. However, in different embodiments, the first column receptacle 222 can be configured to receive the entire the first column end 313.

On the other hand, the second column 320 is substantially identical to the first column 310 and also has a center portion 312 and a first column ends 313 with reduced dimension. Similarly, the dimension of the first column end 313 corresponds to the inner space of the second column receptacle 222. Thus, the second column receptacle 222 can receive the first column end 313 of the second column 320 and maintain the second column 320 in a vertical orientation. In the present embodiment, the second column receptacle 222 is not configured to receive the entire first column end 313. However, in different embodiments, the first column receptacle 222 can be configured to receive the entire first column end 313.

Figure 4A:
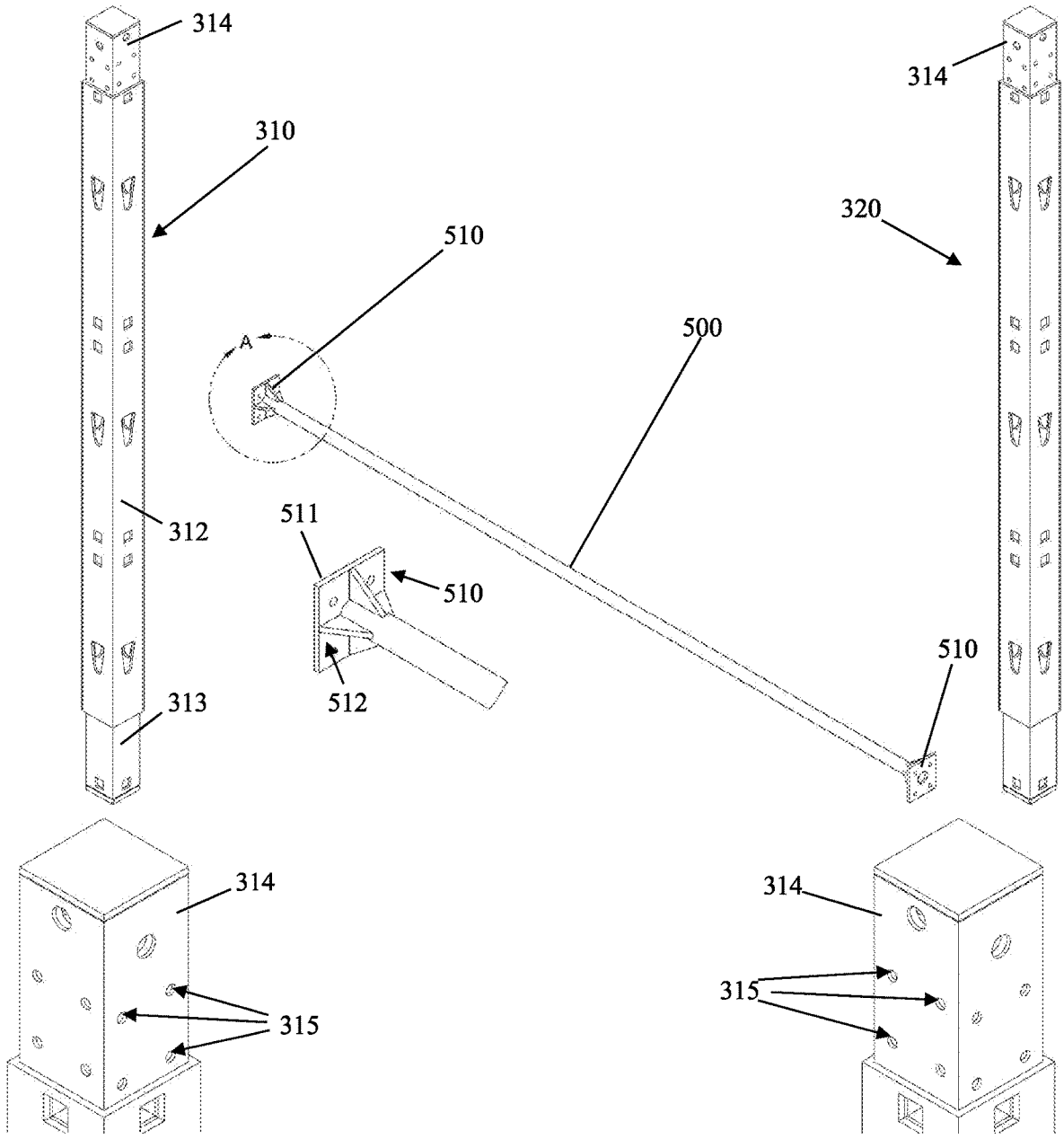
FIGS. 4A and 4B are perspective views of the first column, the second column, and the column bar frame according to the first embodiment of the present disclosure.
Figure 4B:
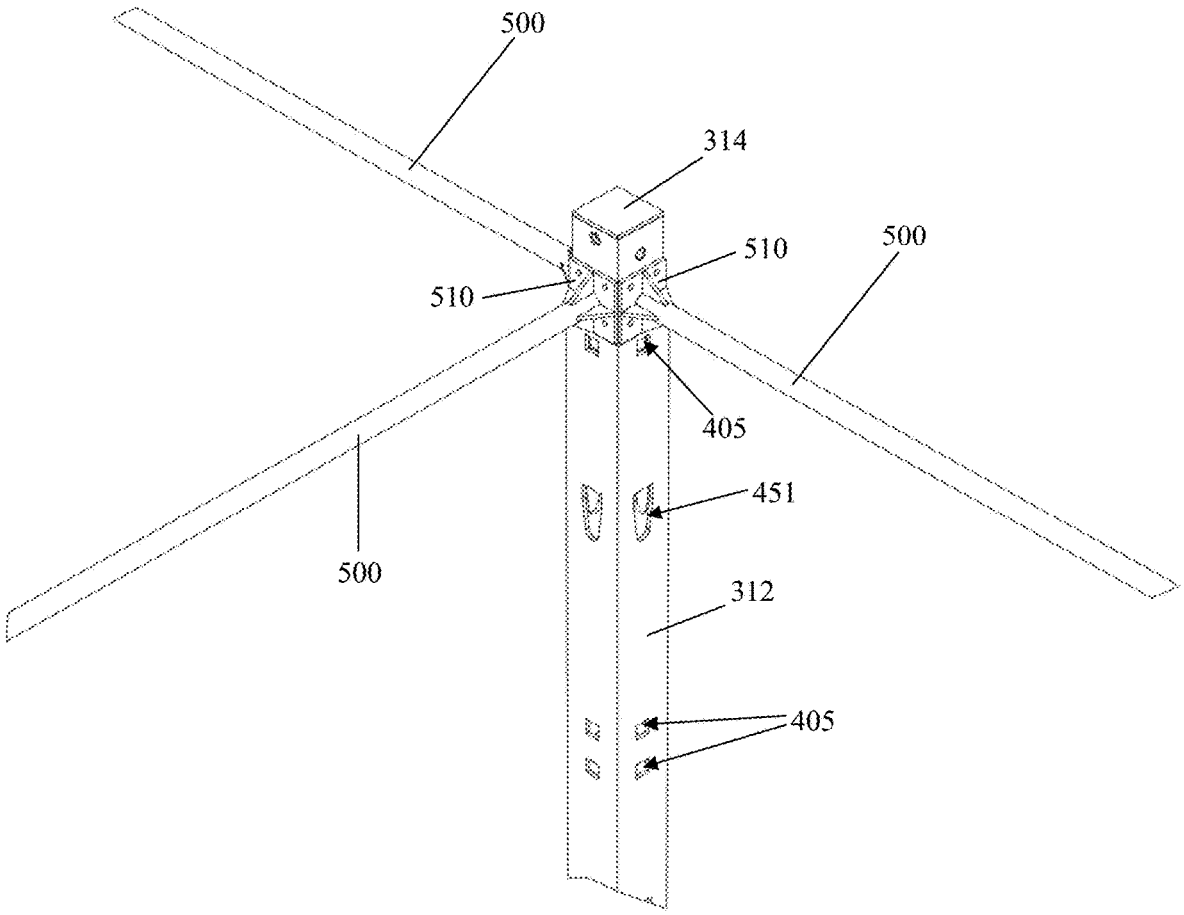

FIGS. 4A and 4B are perspective views of the first column 310, the second column 320, and the column bar 500 according to the first embodiment of the present disclosure. The first column 310 includes a second column end 314 and four fourth threaded openings 315 formed on the second column end 314. Similarly, the second column 320 includes a second column end 314 and four fourth threaded openings 315 formed on the second column end 314.

On the other hand, the column bar 500 includes two attachment member 510 formed on two opposite ends of the column bar 500. The attachment member 510 has an attachment portion 511 and four fifth threaded openings 512 formed on the attachment portion 511. To couple the column bar 500 with the first column 310, firstly the attachment portion 511 of attachment member 510 is placed on one side of the second column end 314 of the first column 310, wherein the fifth threaded openings 512 must be aligned with the fourth threaded openings 315 on the second column end 314. The user can then move four bolts or other fasteners to rotatably pass through the threaded openings 314, 512 and couple the column bar 500 with the first column 310. The column bar 500 coupled with the first and second columns 310, 320 is illustrated in FIG. 4B. Together the two column receptacle 221, 222, the two base members 210, 220, the two auxiliary base members 230, and the column bar 500 ensure that the first and second columns 310, 320 are oriented vertically and maintain the relative distance between the two columns 310, 320.

Figure 5A:
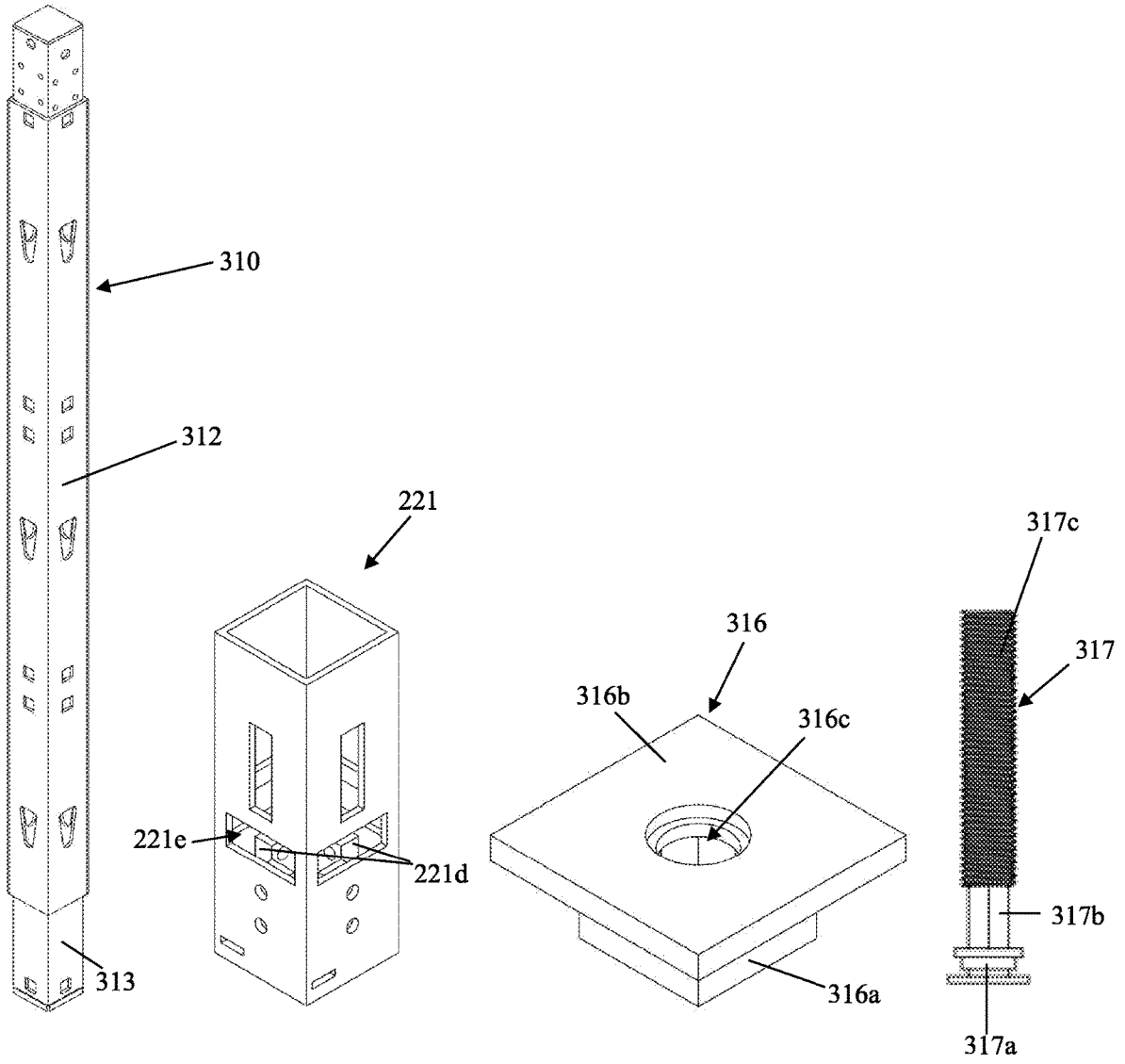
FIG. 5A is a perspective view of a column elevation system of the modular gym according to the first embodiment of the present disclosure.
Figure 5B:
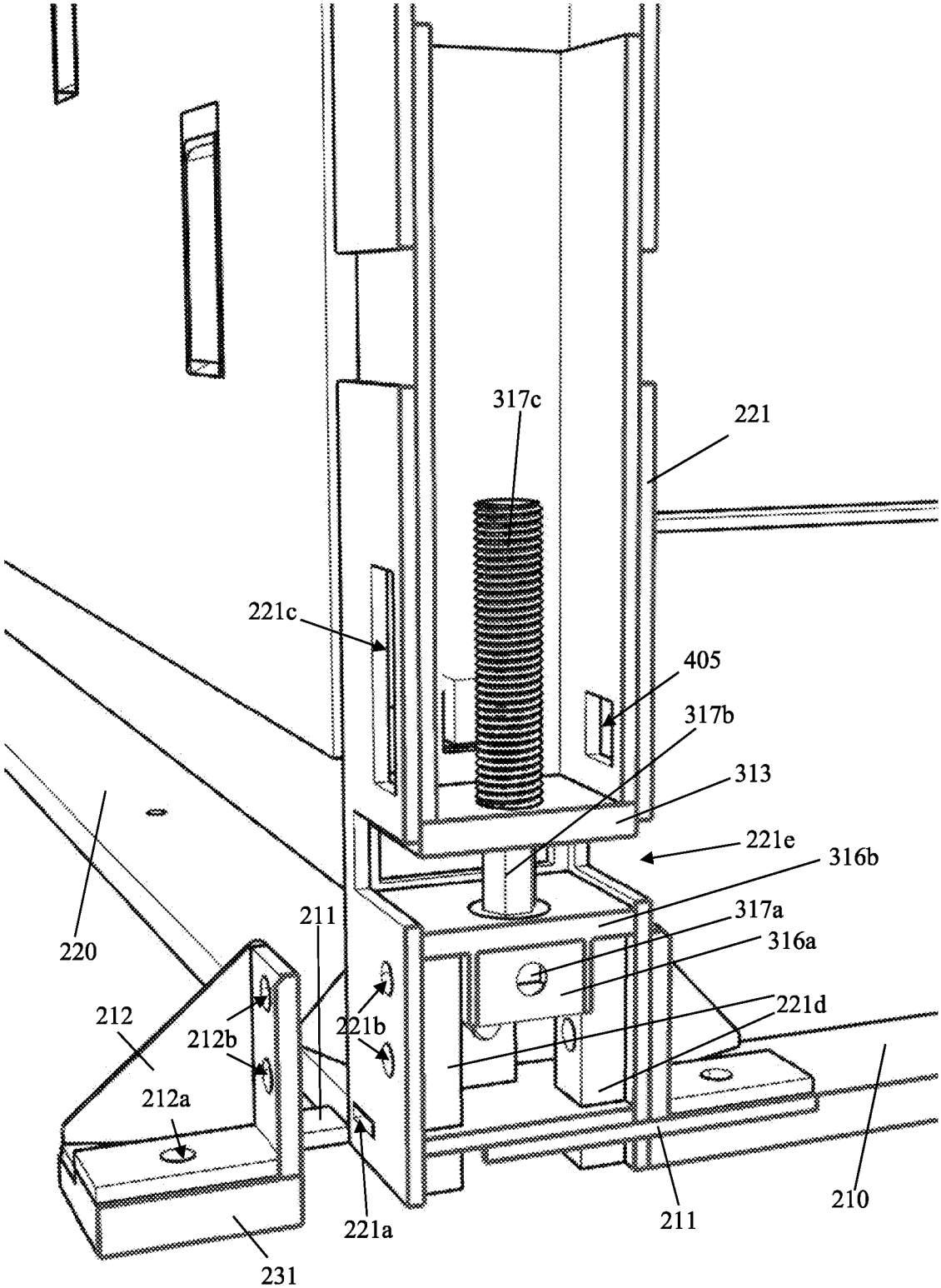
FIG. 5B is a cross-section view of the column elevation system of the modular gym according to the first embodiment of the present disclosure.

FIG. 5A is a perspective view of a column elevation system of the modular gym according to the first embodiment of the present disclosure. The column elevation system includes the first column receptacle 221, the first column 310, a column base 316, and a column bolt 317. Please note that the first column receptacle 221, column base 316, and column 317 are scaled up in FIG. 5A to better illustrate said components in detail. FIG. 5B is a cross-section view illustrating the first column receptacle 221, the first column 310, the column base 316, and the column bolt 317 assembled to form the column elevation system.

As illustrated in FIG. 5A, the column base 316 includes a first base portion 316*a*, a second base portion 316*b*, and a through-hole 316*c*. The first base portion 316*a* is hollow and its inner space is connected to the through-hole 316*c*. On the other hand, the first column receptacle 221 includes four base seats 221*d* for the column base 316 to be placed thereon. A space exists between the four base seats 221*d* and is configured to fit the first base portion 316*a* when the column base 316 is placed on the base seats 221*d* as illustrated in FIG. 5B.

The column bolt 317 includes a first bolt portion 317*a*, a second bolt portion 317*b*, and a tapped third bolt portion 317*c*. The first base portion 316*a* of the column base 316 is hollow and is configured to fit the first bolt portion 317*a* so that the second and third bolt portion 317*b*, 317*c* can protrude outside the column base 316 as illustrated in FIG. 5B.

In the present embodiment, the bottom of the first column ends 313 has a tapped hole configured to couple with the third bolt portion 317*c*. A user can then rotate the column bolt 317 in a clockwise or counter-clockwise direction in order to move the first column 310 vertically upward or downward via the threads on the tapped hole and the third bolt portion 317*c*.

Further, as illustrated in FIGS. 5A and 5B, the first column receptacle 221 include fours adjustment openings 221*e* configured to expose the second bolt portion 317*b*. Thus, a user can use a tool such as a wrench or plier to rotate the second bolt portion 317*b* (exposed through the adjustment openings 221*e*) which in turn rotate the third bolt portion 317*c* and move the first column 310 vertically upward or downward via the threads on the tapped hole and the third bolt portion 317*c*.

Figure 6:
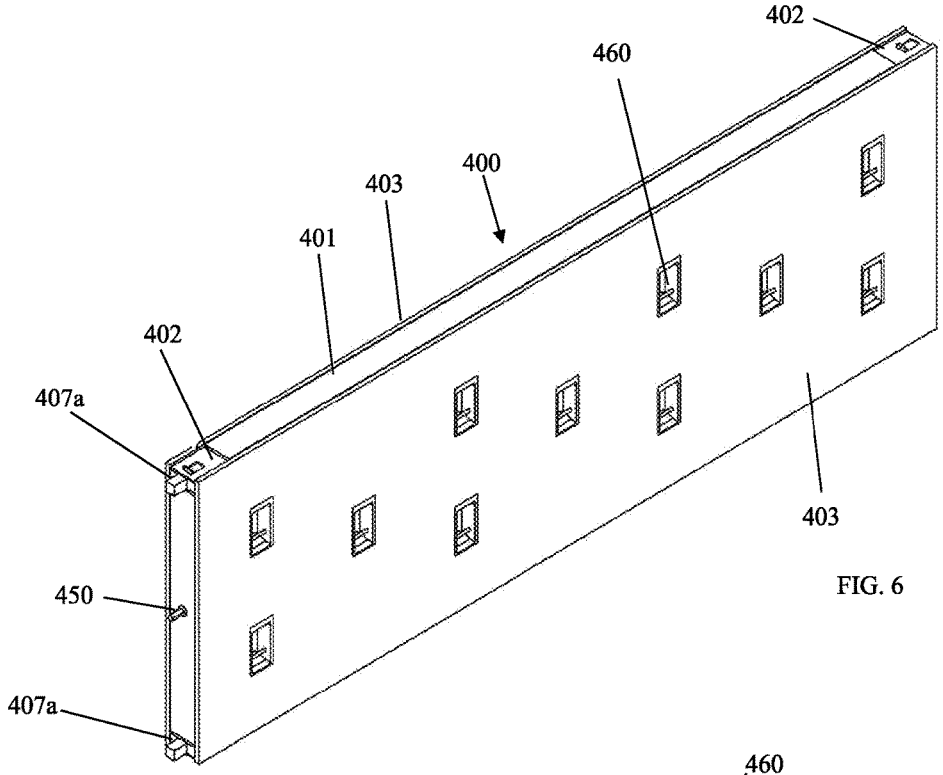
FIGS. 6 and 7 are respectively a perspective view and a front view of a panel according to the first embodiment of the present disclosure.
Figure 7:
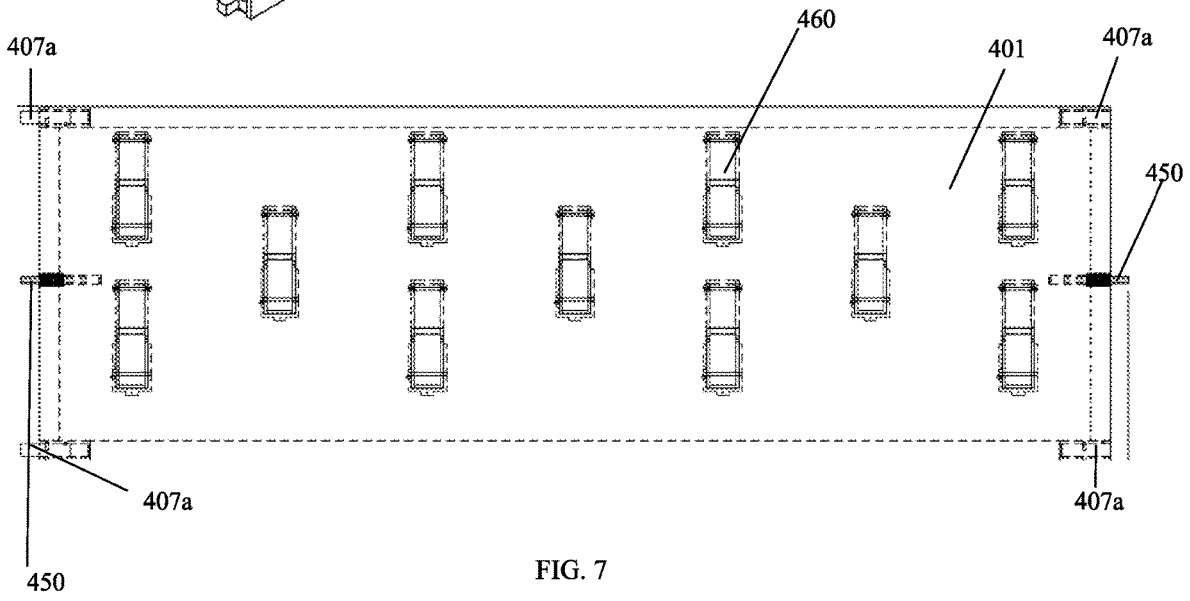

FIGS. 6 and 7 are respectively a perspective view and a front view of a panel 400 according to the first embodiment of the present disclosure. The panel 400 is configured to couple with two columns in two manners. The panel 400 can be either rotatably coupled with the two columns or fixed on the two columns and oriented vertically to form a wall.

The panel 400 includes a panel body 401 having a plurality of openings and a plurality of bar receptacles 460 occupying said openings on the panel body 401. The panel 400 also includes two pairs of column couplers 402 disposed on two opposite ends of the panel body 401. In the present embodiment, the column couplers 402 are disposed at four corners of the panel body 401. The column couplers 402 are configured to detachably couple with the two columns 310, 320 to fix the position of the panel 400 relative to said columns 310, 320.

The panel 400 further includes a rotator 450 partially fitted inside the panel body 401. More preferably, the rotator 450 is fitted in the middle section of the panel body 401. Also, the panel 400 further includes a pair of panel boards 403 attached to two opposite sides of the panel body 401 to maintain the positions of the column couplers 402 and bar receptacles 460 on or within the panel body 400.

Figure 8:
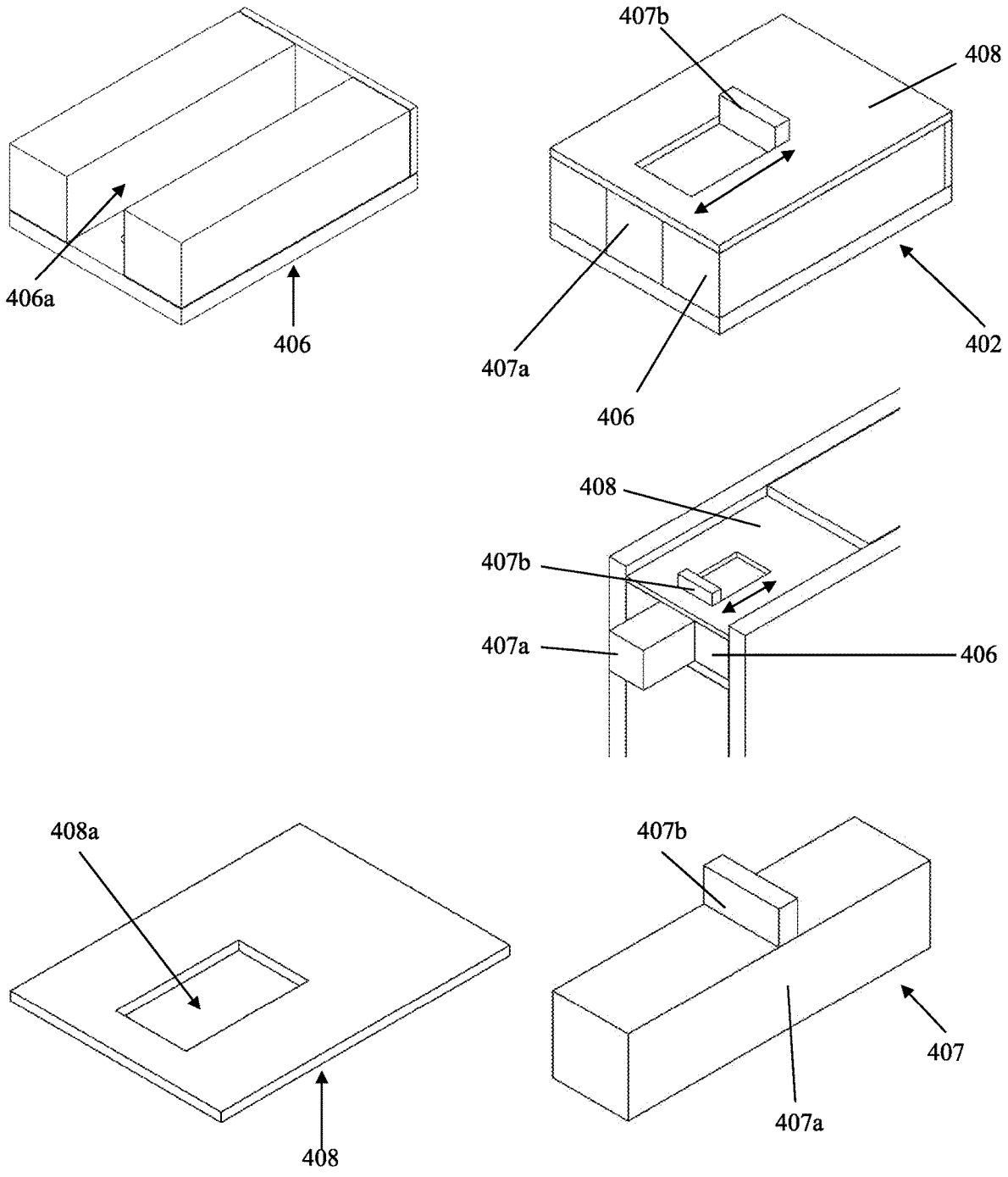
FIG. 8 is a perspective view of various components of the column coupler according to the first embodiment of the present disclosure.

FIG. 8 is a perspective view of the column coupler 402 and various components thereof. The column coupler 402 includes a coupler body 406, a coupler arm 407, and a coupler cover 408. The coupler body 406 includes a groove 406*a* configured to receive the coupler arm 407. The coupler arm 407 includes a first portion 407*a* and a second portion 407*b* extending vertically from the first portion 407*a*. Further, the groove 406*a* is configured to have identical dimension as that of the first portion 407*a* to contain the entire first portion 407*a*. The coupler cover 408 is placed on top of the coupler body 406 and coupled with the coupler body 406 to maintain the first portion 407*a* within the groove 406*a*. The coupler cover 408 has a first cover opening 408*a* for the second portion 407*b* to protrude from said first cover opening 408*a*.

A user can move the second portion 407*b* (protruding outside first cover opening 408*a*) horizontally to move the coupler arm 407 between: a first position where the first portion 407*a* is contained entirely within the groove 406*a*; and a second position where the first portion 407*a* protrudes outside the groove 406*a*. When the column coupler 402 is attached to the panel body 401 and the coupler arm 407 is in the first position, the first portion 407*a* is located entirely within the corresponding end of the panel body 401, as illustrated in FIG. 7 by the first portions 407*a* on the right side of the panel 400. On the other hand, when the coupler arm 407 is in the second position, the first portion 407*a* extends beyond one end of the panel body 407, as illustrated in FIG. 7 by the first portions 407*a* on the left side of the panel 400.

Figure 9:
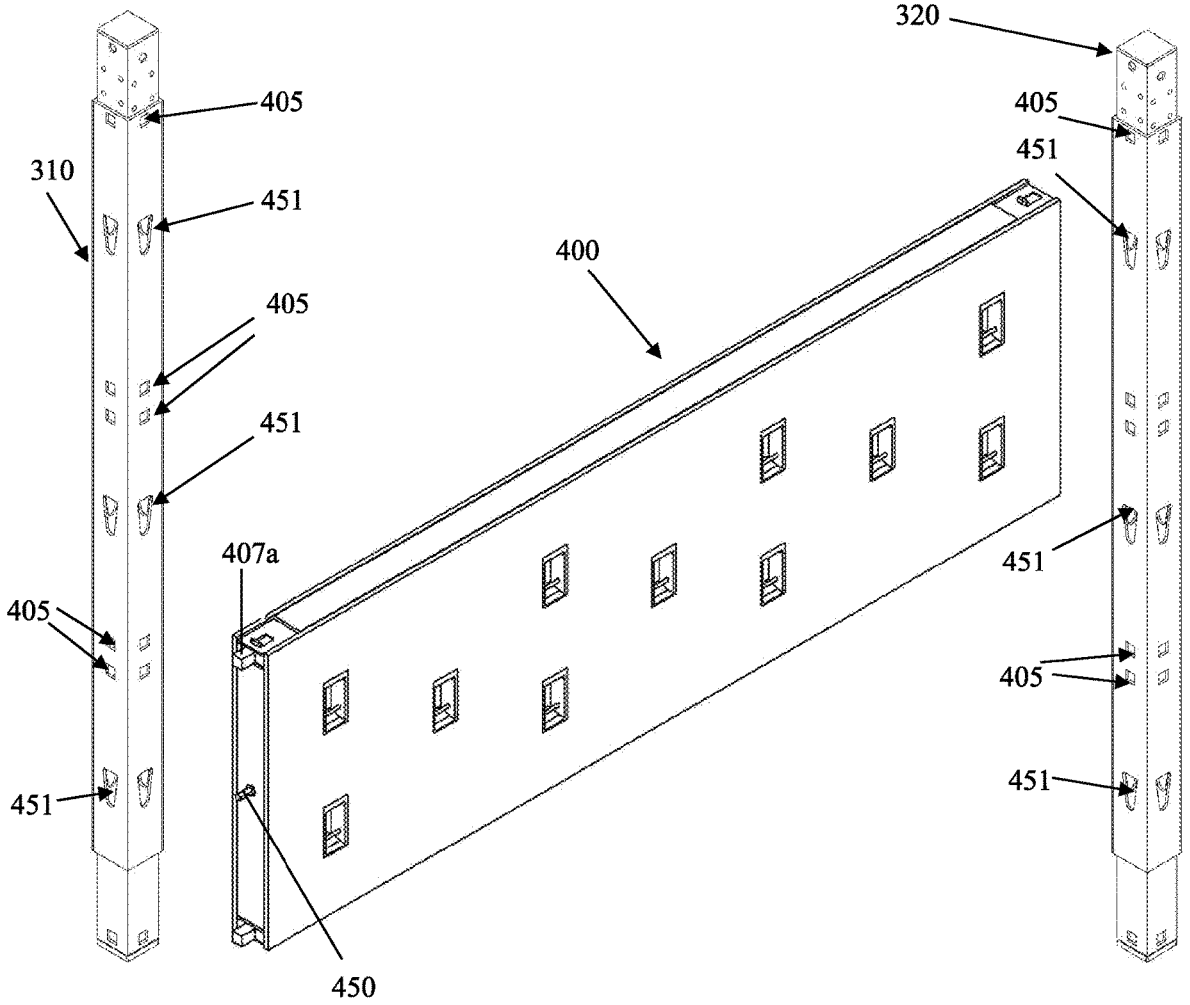
FIG. 9 is a perspective view of the first column, the second column, and the panel according to the first embodiment of the present disclosure.
Figure 10:
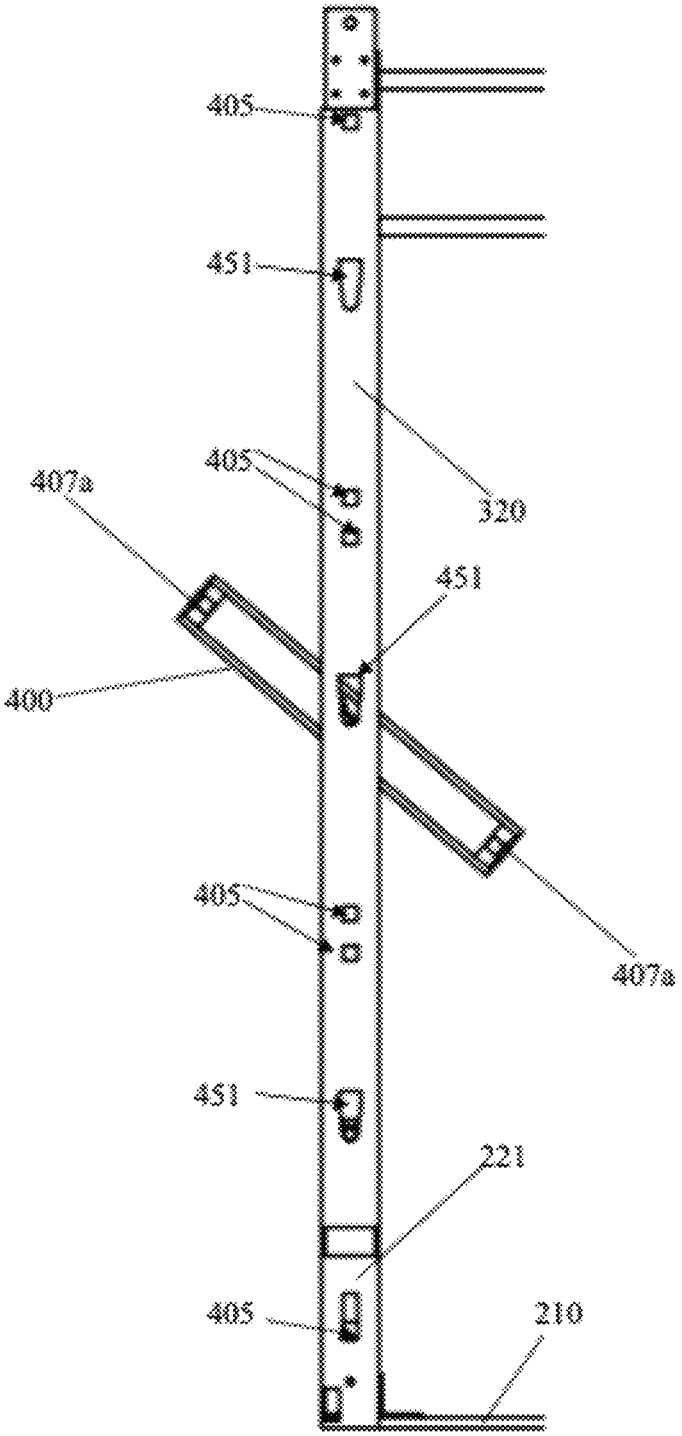
FIG. 10 is a side view showing the panel rotatably coupled with the second column according to the first embodiment of the present disclosure.

FIG. 9 is a perspective view of the first column 310, the second column 320, and the panel 400. FIG. 10 is a side view showing the panel 400 rotatably coupled with the second column 320. Both first and second columns 310, 320 include three rotator openings 451 each configured to accommodate one rotator 450 of the panel 400. The columns 310, 320 each includes three pairs of coupler openings 405, wherein each coupler opening 405 is configured to receive the first portion 407*a* extending outside one end of the panel 400.

To couple the panel 400 to the first and second columns 310, 320, first the rotators 450 should be placed in the corresponding rotator openings 451 on the two columns 310, 320. Before the first portions 407*a* are inserted in the corresponding coupler openings 405 on the two columns 310, 320, the panel 400 is rotatable with the rotators 450 in rotator openings 451. Once any of the first portions 407*a* is inserted in the corresponding coupler openings 405, the position of the panel 400 is fixed between the columns 310, 320. The panel 400 is then oriented vertically to form a wall between the two columns 310, 320, as illustrated in FIGS. 1A-B. In the present embodiment, the first and second columns 310, 320 are configured to couple with three panels at most, as illustrated in FIG. 1. However, in different embodiments, the first and second columns 310, 320 can be combined to form a longer column having more coupler openings 405 and more rotator openings 451 to couple with more panels and form a greater panel wall.

Figure 11:
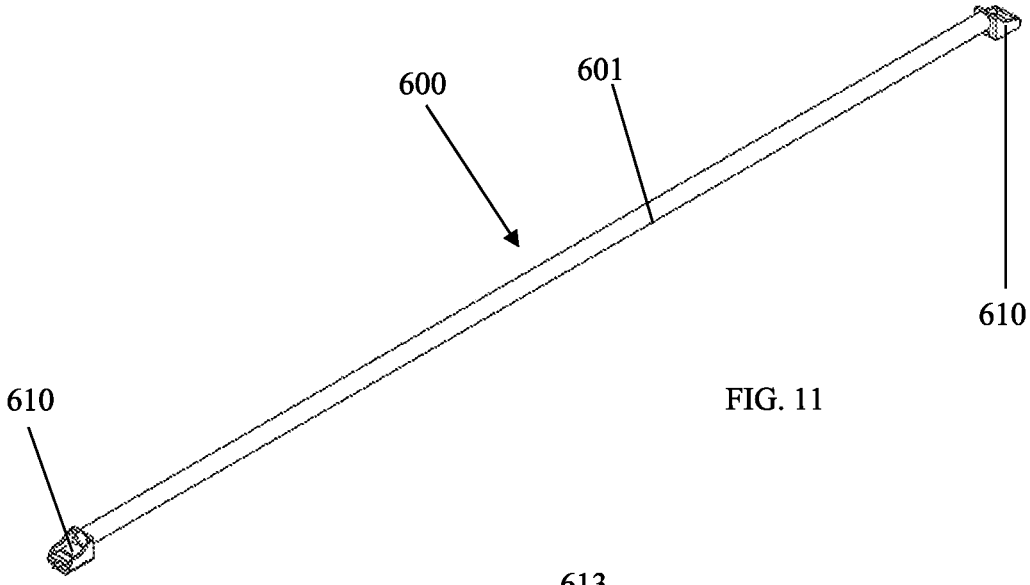
FIG. 11 is a perspective view of the panel bar according to the first embodiment of the present disclosure.

FIG. 11 is a perspective view of the panel bar 600 according to the first embodiment of the present disclosure. The panel bar 600 has a panel bar body 601, a pair of panel fasteners 610 disposed on two opposite sides of the panel bar body 601. The panel fasteners 610 are configured to be respectively placed in the bar receptacles 460 of two panels facing each other as illustrated in FIGS. 1A, 1B, 16 and 17.

Figure 12:
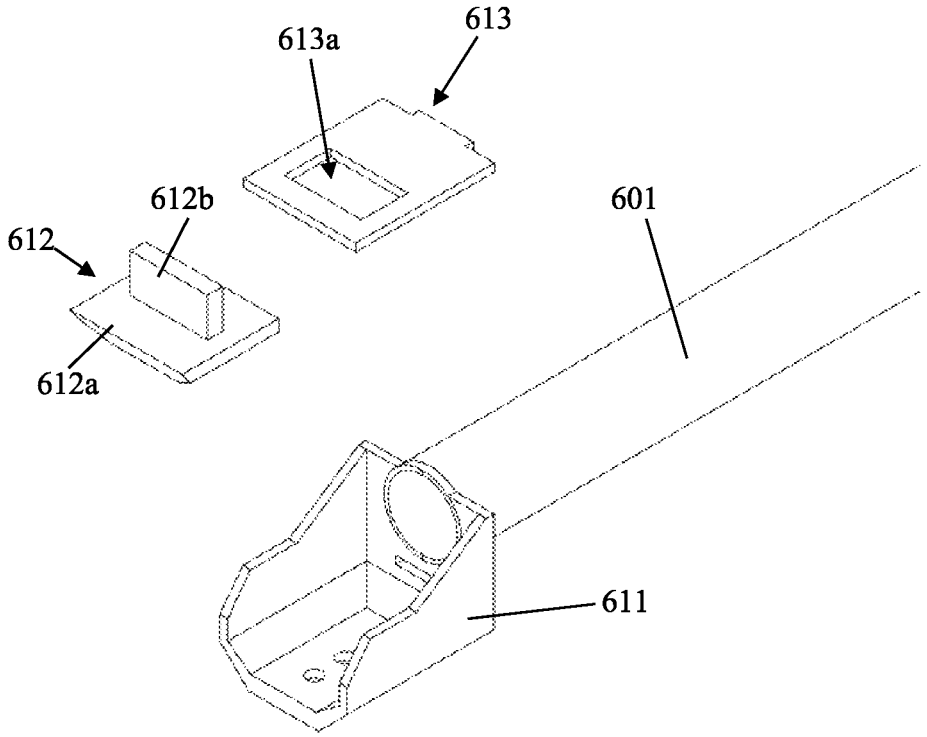
FIG. 12 is an explosion view of the first fastener according to the first embodiment of the present disclosure.
Figure 13:
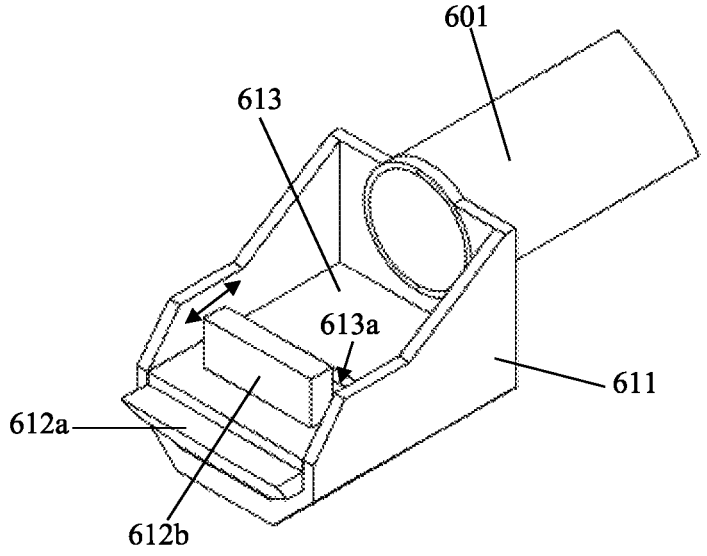
FIG. 13 is an enlarged perspective view of the first fastener also illustrated in FIG. 11.

FIG. 12 is an explosion view of the first fastener 610. FIG. 13 is an enlarged perspective view of the first fastener 610 also illustrated in FIG. 11. The first fastener 610 includes a first tongue 611, a second tongue 612, and a fastener cover 613. The first tongue 611 is connected to the panel bar body 601 and has an open container portion configured to receive the second tongue 612. The second tongue 612 has a first tongue portion 612*a* and a second tongue portion 612*b* extending perpendicularly from the first tongue portion 612*a*. The fastener cover 613 is disposed on the second tongue 612 and coupled with the first tongue 611 to restrict the vertical movement of the second tongue 612. The fastener cover 613 has a second cover opening 613*a* for the second tongue portion 612*b* to protrude therefrom. Once the first tongue 611, second tongue 612, and fastener cover 613 are assembled as illustrated in FIG. 13, a user can move the second tongue 612 horizontally using the second tongue portion 612*b* horizontally, wherein the extent that the second tongue portion 612*b* can be moved is based on the width of the second cover opening 613*a*. Please note that FIG. 13 illustrates the first tongue portion 612*a* extending outside one end of the first tongue 611. The first tongue portion 612*a* can also be retracted to the space between the first tongue 611 and the fastener cover 613 by moving the second tongue portion 612*b* toward the panel bar body 601.

Figure 14A:
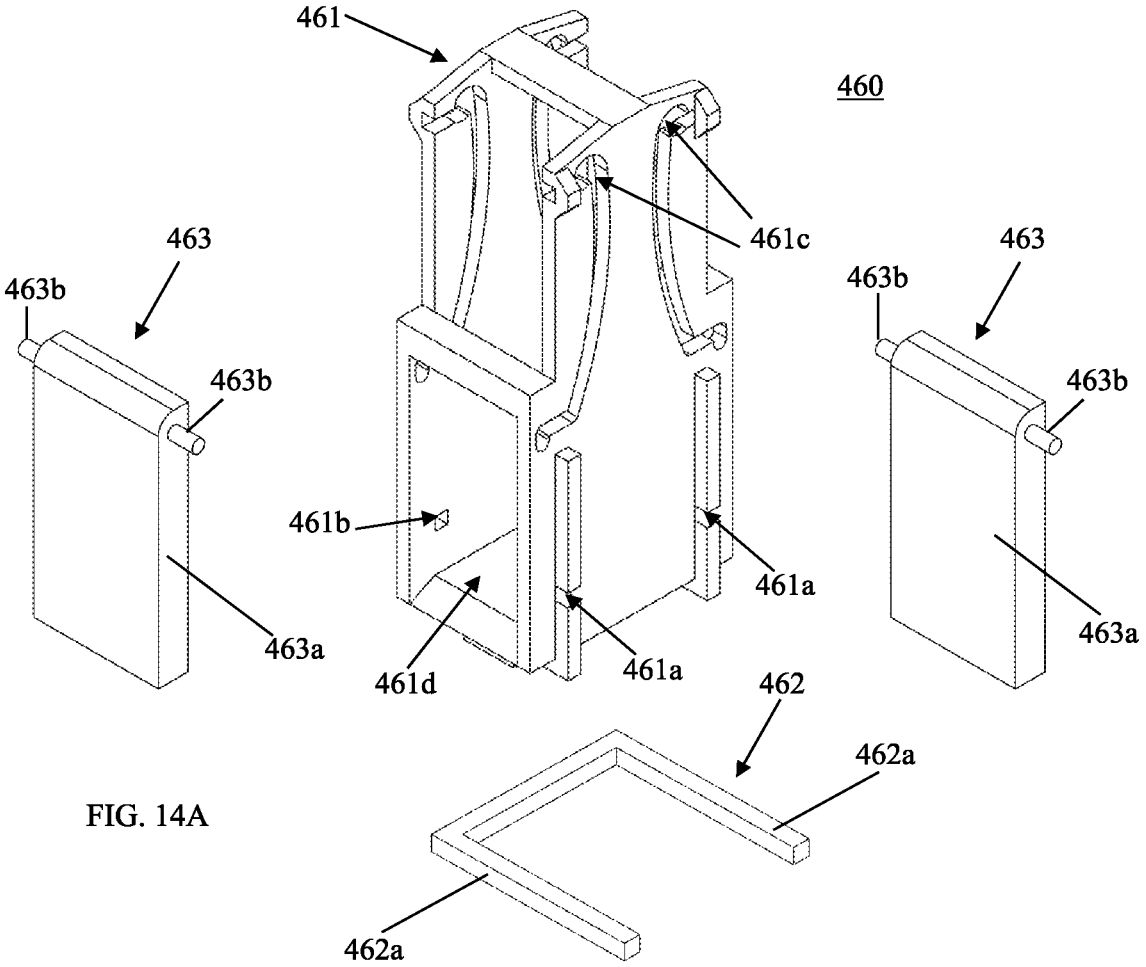
FIGS. 14A and 14B are respectively an explosion view and a perspective view of the bar receptacles according to the first embodiment of the present disclosure.
Figure 14B:
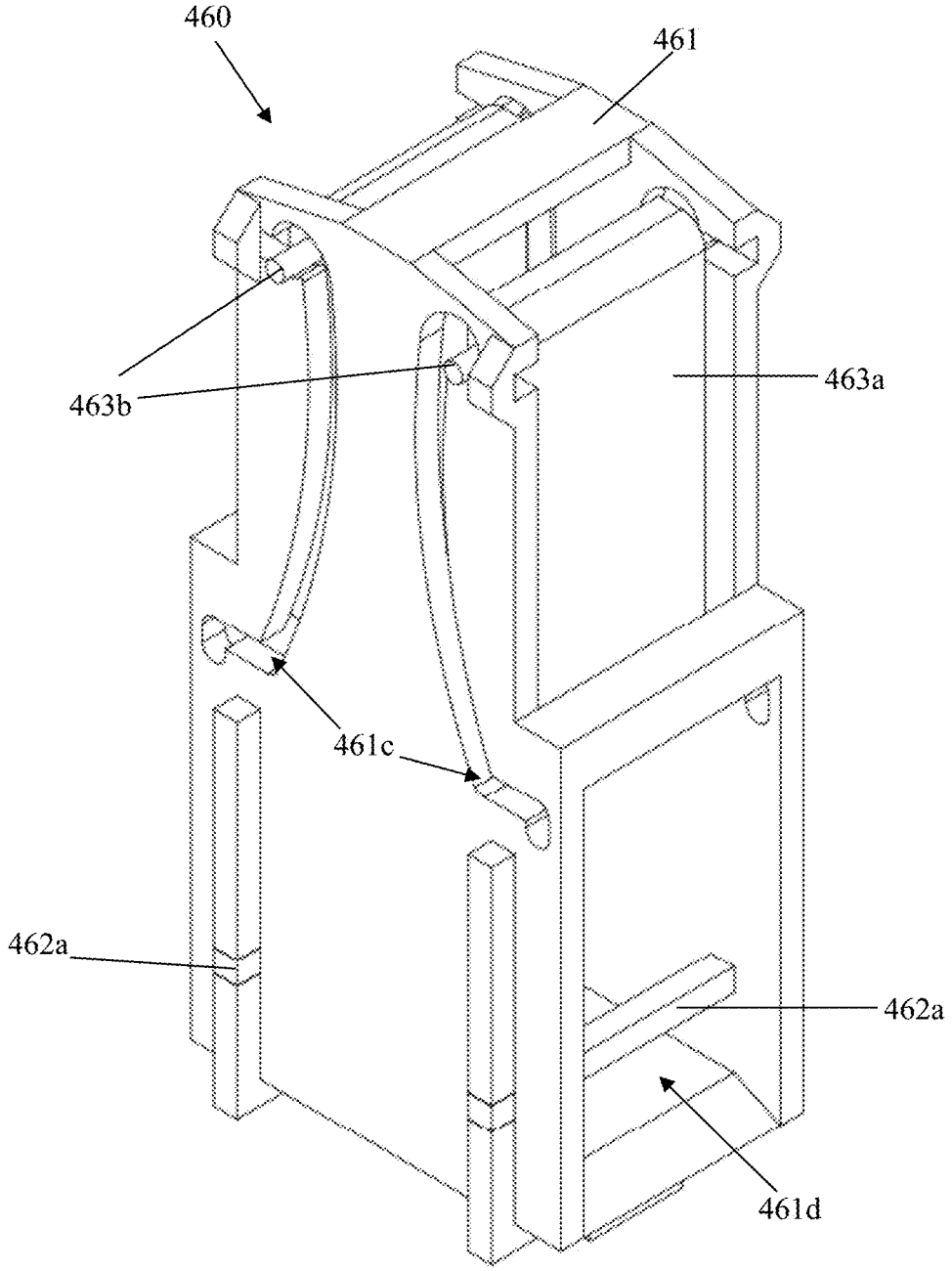

FIGS. 14A and 14B are respectively an explosion view and a perspective view of the bar receptacles 460 according to the first embodiment of the present disclosure. The bar receptacle 460 includes a receptacle body 461, a stopper member 462, and a pair of doors 463. The receptacle body 461 includes two pairs of a first stopper opening 461*a* and a second stopper opening 461*b* configured for the stopper member 462 to pass through and couple with the receptacle body 461. The receptacle body 461 further includes two pairs of slider grooves 461*c* and a pair of receptacle openings 461*d*. The door 463 includes a door body 463*a* and a pair of door protrusions 463*b* extending from two opposite sides of the door body 463*a*. The door protrusions 463*b* is configured to be movably placed in the slider grooves 461*c*, wherein the door 463 is movably between: a first position where the door protrusion 463*b* reaches the bottom end of the slider groove 461*c* and the door 463 cover the corresponding receptacle opening 461*d*; and a second position where the door protrusion 463*b* is at the top of the slider groove 461*c* and the door 463 and the door 463 does not cover the corresponding receptacle opening 461*d*, as illustrated in FIG. 14B. The door 463 in the second position allows the fastener 610 to be placed in the space between two receptacle openings 461*d* of the receptacle body 461 as illustrated in FIGS. 15-16.

In the present embodiment, the stopper member 462 is C-shaped and has a pair of stopper arms 462*a*. The stopper arms 462*a* are configured to pass through the first stopper opening 461*a* to reach the second stopper opening 461*b*, so that the stopper arms 462*a* are located in the space between two receptacle openings 461*d* as illustrated in FIGS. 15-16.

Figure 15:
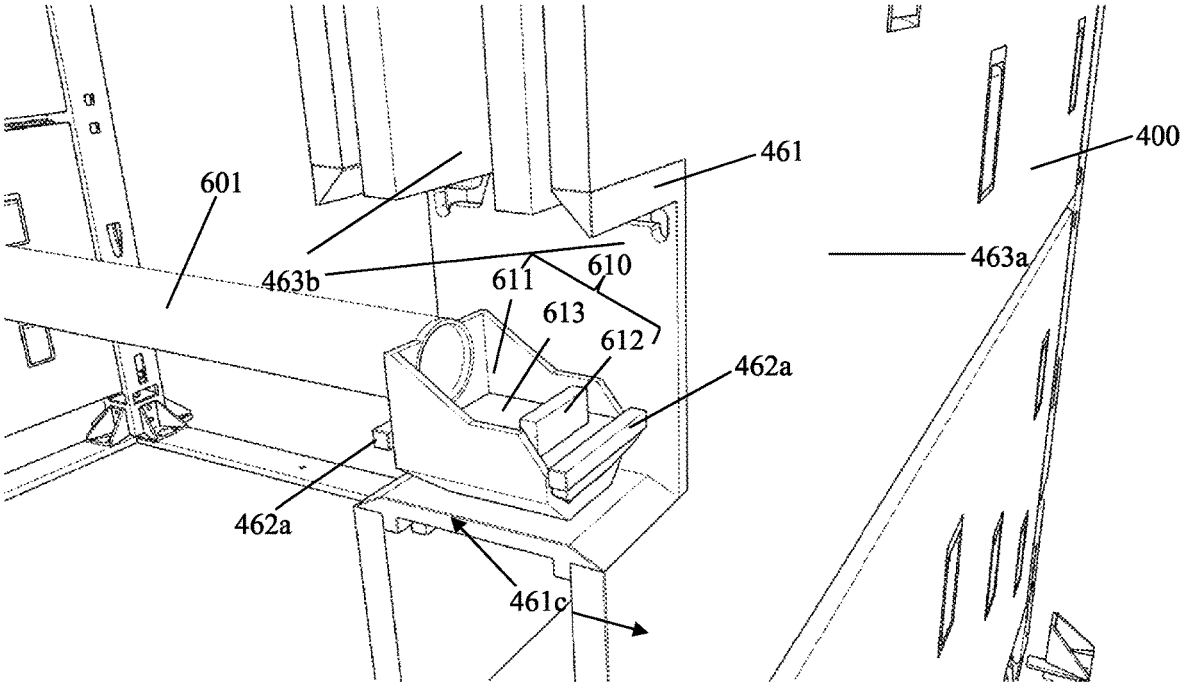
FIGS. 15-16 are two perspective cross-section views of the fastener placed in the receptacle body of the bar receptacles.
Figure 16:
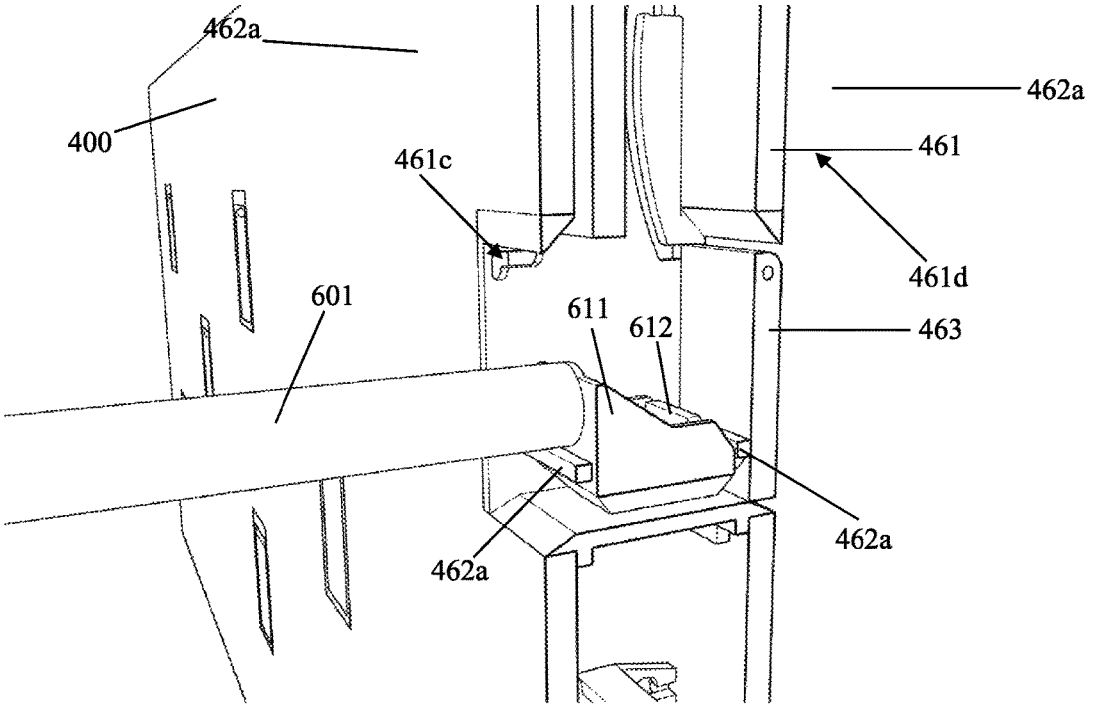

FIGS. 15-16 are two perspective cross-section views of the fastener 610 placed in the receptacle body 461 of the bar receptacles 460. As mentioned above, the second tongue 612 is movable between: a first position where the first tongue portion 612*a* extends outside one end of the first tongue 611; and a second position where the first tongue portion 612*a* is retracted to the space between the first tongue 611 and the fastener cover 613. FIGS. 14-15 illustrate the second tongue 612 in the above-mentioned first position. When the second tongue 612 is in the first position, one of the stopper arms 462*a* is located directly above the first tongue portion 612*a* and thus prevents the second tongue 612 and by extension the entire fastener 610 from being moved upwards. As illustrated in FIGS. 15-16, the two stopper arms 462*a* also blocks the movement of the first tongue 611 in the horizontal direction. Thus, when the fastener 610 is placed between two stopper arms 462*a* and the second tongue 612 is in the first position, the fastener 610 and by extension the entire the panel bar 600 are fixed in the bar receptacles 460.

Figure 17:
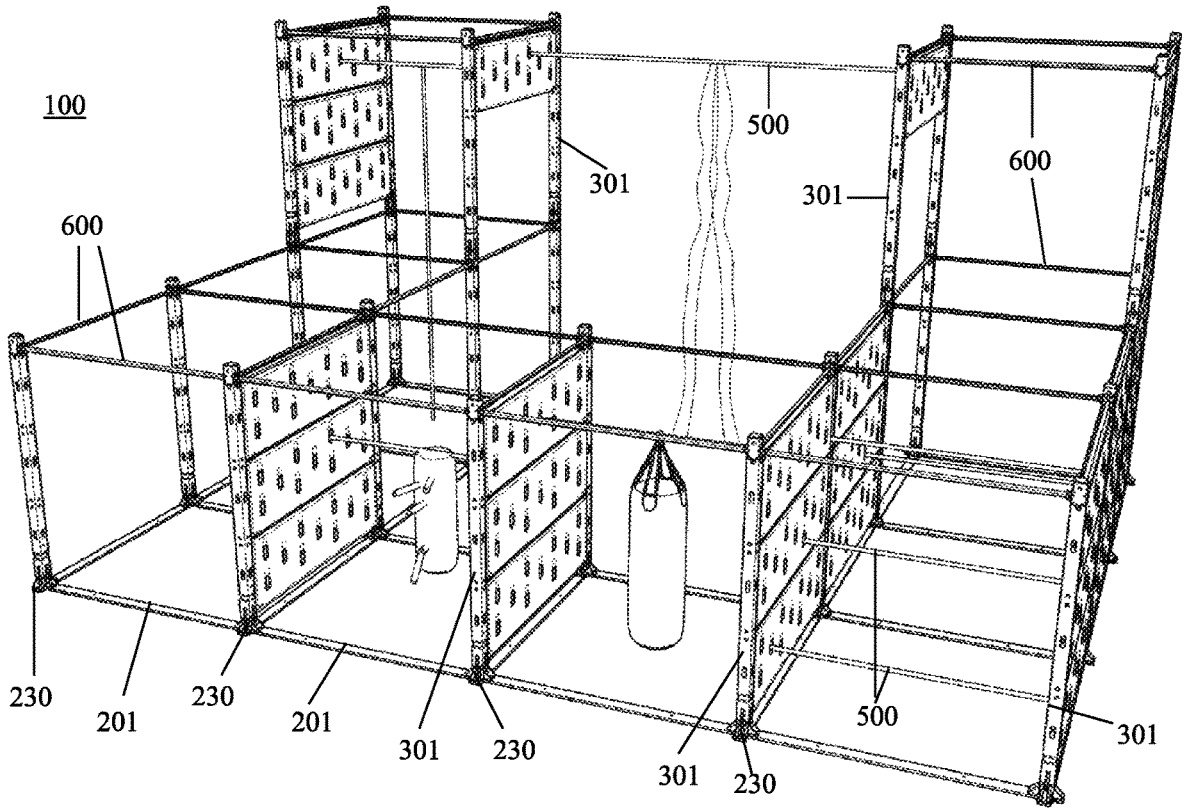
FIG. 17 is a perspective view of the modular gym according to a second embodiment of the present disclosure.

FIG. 17 is a perspective view of the modular gym 100 according to a second embodiment of the present disclosure. The modular gym 100 includes a plurality of base members 201, auxiliary base members 230, columns 301, panels 400, column bars 500, and panel bars 600. The base members 201 are identical to the first base member 210 described above. The columns 301 are identical to the first column 310 described above. The modular gym 100 of the second embodiment is a collection of the modular gym units illustrated in FIG. 1 and connected using additional base members 201, auxiliary base members 230, and column bars 500. The panels 400 can be selectively coupled to any two of the columns 301 and the panel bar 600 can then be coupled with two panels 400 facing each other.

The modular gym unit of the first embodiment is a single level embodiment located on the ground floor. On the other hand, the modular gym 100 of the second embodiment includes two of the columns 301 combined to form a long column, wherein the upper halves of the long columns forms the second level of the modular gym 100. A panel 400 or column bars 500 can be coupled to two long columns, wherein a panel bar 600 can be coupled with two panels 400 on the second level and facing each other as illustrated in FIG. 17.

Figure 18:
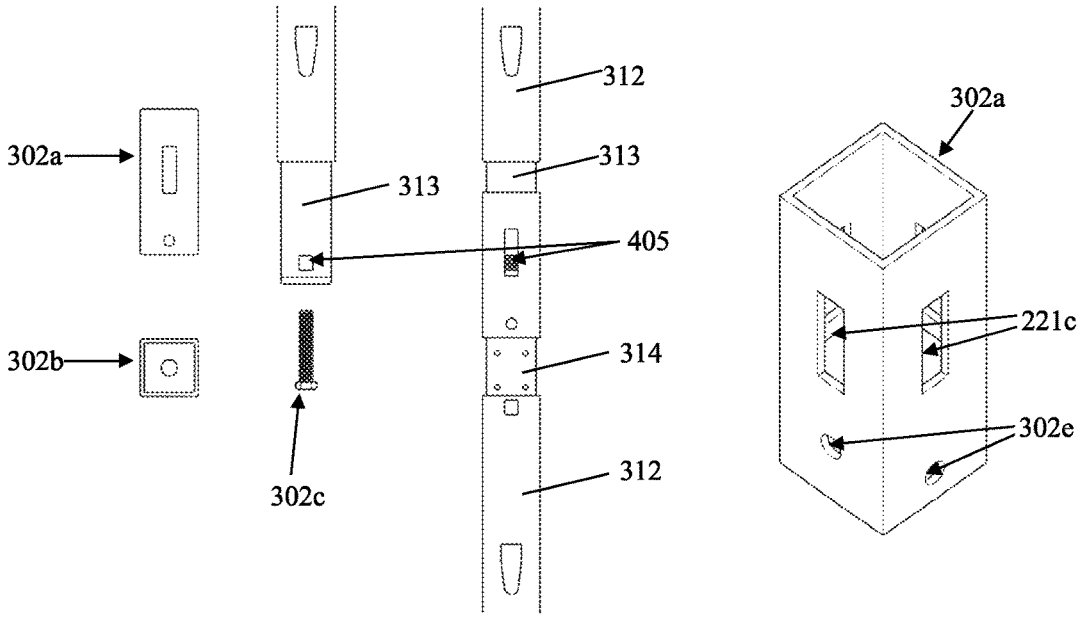
FIG. 18 is a perspective view of a column stacker and a side view of two columns combined to form a long column.
Figure 19:
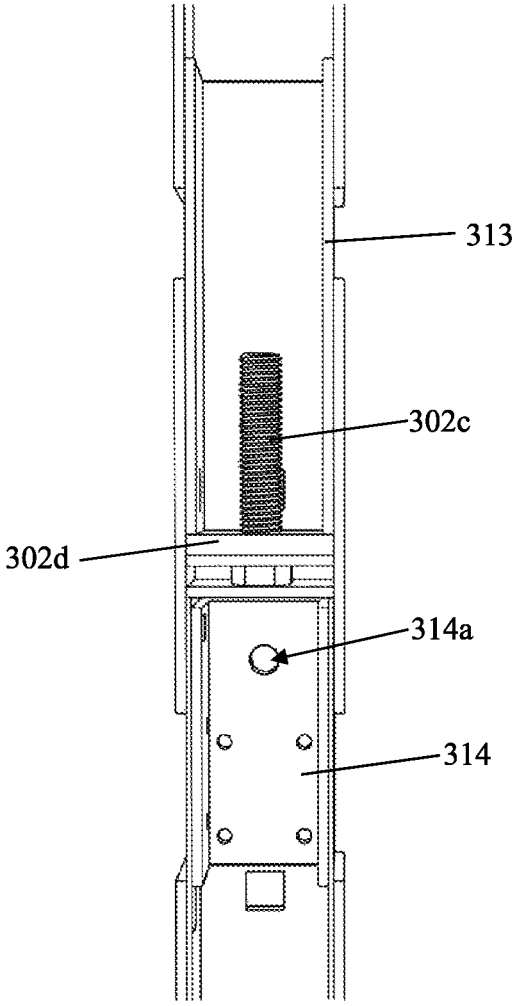
FIG. 19 is a cross-section view of the long column including the column stacker and two columns.

FIG. 18 is a perspective view of a column stacker and a side view of two short columns 301 combined with the column stacker to form a long column. FIG. 19 is a cross-section view of the long column including the column stacker and two short columns 301. The column stacker includes a stacker body 302*a*, a spacer 302*b*, and a stacker bolt 302*c*. The stacker body 302*a* is hollow and has a bottom portion 302*d* (illustrated in FIG. 19) having a tapped opening for the stacker bolt 302*c* to rotatably pass through. The stacker body 302*a* includes a first stacker opening 302*e* formed on four sides of the stacker body 302*a*. The stacker body 302*a* also includes rectangular second coupler openings 221*c* each formed on one side of the stacker body 302*a*. When the first column end 313 of the column 301 is inserted in the stacker body 302*a*, part of the first column end 313 will be exposed through the second coupler opening 221*c*.

As illustrated in FIG. 19, the second column end 314 of the lower column 301 has a tapped opening 314*a* corresponding to the first stacker opening 302*e*, where a thread bolt or other fasteners (not illustrated) can be used to rotatably pass through the openings 302*e*, 314*a* to couple the stacker body 302*a* with the second column end 314 of the lower column 301.

As mentioned above, the bottom of the first column ends 313 has a tapped hole (not illustrated), wherein the stacker bolt 302*c* can rotatably pass through the tapped opening on the bottom portion 302*d* and that of the first column ends 313 to couple the stacker body 302*a* with the second column end 314 of the upper column 301.

The foregoing descriptions of specific implementations have been presented for purposes of illustration and description. They are not intended to be exhaustive or to limit the invention to the precise forms disclosed, and modifications and variations are possible in view of the above teaching. The exemplary implementations were chosen and described to best explain the principles of the invention and its practical application, to thereby enable others skilled in the art to best utilize the invention and its implementations with modifications as suited to the use contemplated.

It is therefore submitted that the invention has been shown and described in the most practical and exemplary implementations. It should be recognized that departures may be made which fall within the scope of the invention. With respect to the description provided herein, it is submitted that the optimal features of the invention include variations in size, materials, shape, form, function, manner of operation, assembly, and use. All structures, functions, and relationships equivalent or essentially equivalent to those disclosed are intended to be encompassed by the invention.

The invention claimed is:

1. A modular exercise structure, comprising:

a frame having:

a plurality of first column and a second column oriented vertically; and a first panel located between the first column and the second column, the first panel having:

a first panel body having a first end and a second end opposite to the first end;

a first column coupler disposed in the first end of the first panel body and configured to be coupled with the first column;

a second column coupler disposed in the second end of the first panel body and configured to be coupled with the second column, wherein the first panel is oriented vertically to form a wall between the first column and the second column, wherein the modular exercise structure is configured to be adjustable and modifiable; and a first rotator with one end coupled with a middle section of the first panel body and another end coupled on the first column, wherein the first panel body can be rotated with respect to the first column once the first rotator is coupled with the first column.

2. The modular exercise structure of claim 1, further comprising a base including:

a first base member having a first receptacle coupler and a second receptacle coupler; and a first column receptacle oriented vertically and detachably coupled with the first receptacle coupler, the first column receptacle is configured to receive a first end of the first column and maintain the first column in a vertical orientation; and a second column receptacle detachably coupled with the second receptacle coupler, the second column receptacle is configured to receive a first end of the second column and maintain the second column in a vertical orientation.

3. The modular exercise structure of claim 2, wherein the base includes a second base member having the first receptacle coupler and the second receptacle coupler, the first column receptacle has:

a first side detachably coupled with the first receptacle coupler of the first base member; and a second side detachably coupled with the first receptacle coupler of the second base member.

4. The modular exercise structure of claim 2, wherein the base further includes an auxiliary base member detachably coupled with the first column receptacle, wherein the first column receptacle has a first side detachably coupled with the first receptacle coupler and a second side detachably coupled with the auxiliary base member.

5. The modular exercise structure of claim 2, wherein the first column includes:

a column body with one end received in the first column receptacle and having a threaded hole;

an elevating member disposed in the first column receptacle and having a threaded outer surface, wherein the elevating member is rotatably coupled with the threaded hole, a user can rotate the elevating member to interact with the threaded hole and move the column body vertically upward or downward.

6. The modular exercise structure of claim 1, further comprising a column bar having a first end and a second end opposite to the first end, the column bar including a first attachment piece disposed on the first end of the column bar and detachably coupled with the first column; and a second attachment piece disposed on the second end of the column bar and detachably coupled with the second column.

7. The modular exercise structure of claim 1, wherein the first column includes a first opening and the second column includes a second opening, the first column coupler includes a first arm movable horizontally between:

a first position where the first arm is located entirely within the first end of the panel body; and a second position where the first arm extends beyond the first end to enter the first opening to couple with the first column;

the second column coupler includes a second arm movable horizontally between:

a third position where the second arm is located entirely within the second end of the panel body; and a fourth position where the second arm extends beyond the second end to enter the second opening to couple with the second column.

8. The modular exercise structure of claim 1, wherein the frame further includes a third column, and a fourth column detachably oriented vertically, the module exercise structure further comprises:

a second panel located between the third column and the fourth column, the second panel having:

a second panel body having a first end and a second end opposite to the first end;

the first column coupler disposed in the first end of the second panel body and configured to be coupled with the third column; and the second column coupler disposed in the second end of the first panel body and configured to be coupled with the fourth column, wherein the second panel is oriented vertically to form a wall between the third column and the fourth column; and a panel bar having a first end detachably coupled with the first panel and a second end detachably coupled with the second panel, the panel bar is oriented horizontally.

9. The modular exercise structure of claim 8, wherein the first panel includes a first receptacle and the second panel includes a second receptacle, the panel bar includes:

a panel bar body;

a first fastener disposed on the first end of the panel bar body and disposed in the first receptacle to detachably couple with the first receptacle; and a second fastener disposed on the second end of the panel bar and disposed in the second receptacle to detachably couple with the second receptacle.

10. The modular exercise structure of claim 9, wherein the first receptacle includes:

a receptacle body having an opening; and a first stopper bar disposed in the receptacle body to form a gap between the first stopper bar and a bottom part of the receptacle body;

the first fastener includes:

a first tongue to be placed on the bottom part of the receptacle body; and a second tongue disposed on the first tongue and movable horizontally between:

a first position where the second tongue is located between the first stopper bar and the bottom part of the receptacle body so that the first stopper bar blocks the second tongue from being moved vertically upward; and a second position where the second tongue is not located between the first stopper bar and the bottom part of the receptacle body so that the first stopper bar does not block the second tongue from being moved vertically upward.

11. The modular exercise structure of claim 10, wherein the first receptacle further includes a second stopper bar disposed in the receptacle body, wherein the first and second stopper bars limit a horizontal movement of the first and second tongues in the receptacle body.

12. The modular exercise structure of claim 10, wherein the first receptacle includes:

a receptacle body having a first opening; and a first door movably coupled with the receptacle body and configured to move between:

a first position where the door covers the first opening; and a second position where the door does not cover the first opening.

13. The modular exercise structure of claim 1, wherein the frame further includes a third column oriented vertically, the module exercise structure further comprises:

a third panel located between the first column and the third column, the third panel having:

a third panel body having a first end and a second end opposite to the first end;

a third column coupler disposed in the first end of the third panel body and configured to be coupled with the first column; and a fourth column coupler disposed in the second end of the third panel body and configured to be coupled with the third column, wherein the third panel is oriented vertically to form a wall between the first column and the third column, wherein the first panel and the third panel are perpendicular to each other.

14. The modular exercise structure of claim 1 further comprising:

a fourth panel located between the first column and the second column, the fourth panel having:

a fourth panel body having a first end and a second end opposite to the first end;

a fourth column coupler disposed in the first end of the fourth panel body and configured to be coupled with the first column; and a fifth column coupler disposed in the second end of the fourth panel body and configured to be coupled with the second column, wherein the fourth panel is oriented vertically to form a wall between the first column and the second column.

15. A modular exercise structure, comprising:

a frame having:

a first column, a second column, a third column, and a fourth column oriented vertically; and a first panel coupled with the first column and the second column, the first panel comprising:

a first panel body having a first end and a second end opposite to the first end;

a first column coupler disposed in the first end of the first panel body and configured to be coupled with the first column;

a second column coupler disposed in the second end of the first panel body and configured to be coupled with the second column, wherein the first panel is oriented vertically to form a wall between the first column and the second column; and a first rotator with one end coupled with a middle section of the first panel body and another end coupled on the first column, wherein the first panel body can be rotated with respect to the first column once the first rotator is coupled with the first column;

a second panel coupled with the third column and the fourth column, wherein the first panel and the second panel are parallel; and a third panel coupled with the first column and the third column, wherein the third panel is perpendicular to both the first panel and the second panel.

16. The modular exercise structure of claim 15, further comprising a fourth panel coupled with the first column and the second column, wherein the fourth panel is located between the first column and the second column and directly above the first panel.

17. The modular exercise structure of claim 15, further comprising:

a first column bar located above the first panel and detachably coupled with the first column and the second column;

a second column bar located above the second panel and detachably coupled with the third column and the fourth column, wherein the first column bar and the second column bar are parallel; and a third column bar located above the third panel and detachably coupled with the first column and the third column, wherein the third column bar is perpendicular to both the first column bar and the second column bar.

18. A modular exercise structure, comprising:

a first unit including:

a plurality of first columns oriented vertically;

at least one panel located between two of the first columns, the panel having:

a first panel body having a first end and a second end opposite to the first end;

a first column coupler disposed in the first end of the first panel body and configured to be coupled with one of the first columns;

a second column coupler disposed in the second end of the first panel body and configured to be coupled with another of the first column, wherein the first panel is oriented vertically to form a wall between the two first columns; and a rotator with one end coupled with a middle section of the first panel body and another end coupled on at least one of the plurality of first columns, wherein the first panel body can be rotated with respect to at least one of the plurality of first columns once the rotator is coupled with at least one of the plurality of first columns;

a base expansion coupled with the first unit;

at least one second column detachably coupled with the base expansion and oriented vertically, wherein the panel can be decoupled from the two first columns to then be coupled with one of the first column and the second column.

* * * * *